US012161235B2

(12) United States Patent
Lerner et al.

(10) Patent No.: US 12,161,235 B2
(45) Date of Patent: Dec. 10, 2024

(54) RETROFITTING APPARATUS FOR A CHAIR THAT EXTENDS AROUND SIDES OF AN UPPER BODY PORTION OF A USER SEATED IN THE CHAIR

(71) Applicant: PrivaSeat, LLC, Woodlawn, MD (US)

(72) Inventors: Ari Lerner, Woodlawn, MD (US); Reuven Goodman, Woodlawn, MD (US)

(73) Assignee: PrivaSeat, LLC, Woodlawn, MD (US)

( * ) Notice: Subject to any disclaimer, the term of this patent is extended or adjusted under 35 U.S.C. 154(b) by 0 days.

(21) Appl. No.: 17/081,466

(22) Filed: Oct. 27, 2020

(65) Prior Publication Data

US 2022/0125207 A1 Apr. 28, 2022

(51) Int. Cl.

| | |
|---|---|
| ***G10K 11/00*** | (2006.01) |
| ***A47C 7/62*** | (2006.01) |
| ***A47C 29/00*** | (2006.01) |
| ***E04B 1/99*** | (2006.01) |
| ***G10K 11/16*** | (2006.01) |

(52) U.S. Cl.

CPC ..... *A47C 7/62* (2013.01)

(58) Field of Classification Search

CPC .. A47C 7/62; A47C 7/727; A47C 7/38; A47C 31/11; A47B 97/00; A47B 2200/0085; B60J 1/2091; B60J 11/08; B60J 11/025; B60J 1/2011

See application file for complete search history.

(56) References Cited

U.S. PATENT DOCUMENTS

| | | | | | |
|---|---|---|---|---|---|
| 457,997 | A * | 8/1891 | Lorey | A43D 25/066 | 269/223 |
| 1,423,933 | A * | 7/1922 | Heatlie | B25B 5/166 | 15/220.3 |
| 1,493,792 | A * | 5/1924 | Price | E01B 29/20 | 254/43 |
| 2,110,037 | A * | 3/1938 | De Rosa | F16M 11/40 | 248/104 |
| 2,144,140 | A * | 1/1939 | Batcheller | F16B 2/065 | 24/514 |
| 2,214,204 | A * | 9/1940 | Pollard | A47B 83/02 | 297/171 |
| 2,510,198 | A * | 6/1950 | Tesmer | B25B 5/006 | 248/231.71 |

(Continued)

*Primary Examiner* — Shin H Kim

(74) *Attorney, Agent, or Firm* — LSIP Law LLC

(57) ABSTRACT

Some embodiments are directed to retrofitting apparatus for use with a chair, the chair including a seat portion, a back portion that extends substantially perpendicular to the seat portion, and at least one elongated connector that connects the seat portion and the back portion. The retrofitting apparatus includes a removable coupling structure connectable to the at least one elongated connector of the chair, the removable coupling structure including at least one connecting member configured to extend around a perimeter of a portion of the at least one elongated connector; and a cover connected to the coupling structure, the cover configured to project from at least a 180 degree radius around at least a portion of the back portion of the chair, thereby extending around sides of a chair occupant so as to provide a physical barrier between the chair occupant and those disposed adjacent thereto.

13 Claims, 51 Drawing Sheets

(56) References Cited

U.S. PATENT DOCUMENTS 2,815,555 A * 12/1957 Robbins ..... A01K 65/00 24/514
3,272,540 A * 9/1966 Glanzer ..... E04G 7/14 403/218
3,736,629 A * 6/1973 Blake ..... B25B 5/103 24/514
3,767,261 A * 10/1973 Rowland ..... A47C 7/285 297/452.64
4,134,439 A * 1/1979 Scott ..... A47G 5/00 160/135
4,201,416 A * 5/1980 Vanderminden ..... A47C 7/66 297/184.15
4,278,246 A * 7/1981 Blake ..... B25B 5/103 269/220
4,375,134 A * 3/1983 Sheetz ..... G09F 7/00 116/173
4,580,769 A * 4/1986 Pappas ..... B25B 5/02 269/166
4,619,447 A * 10/1986 Blake ..... B25B 5/103 24/514
4,669,170 A * 6/1987 Blake ..... B25B 5/103 29/283
4,769,962 A * 9/1988 Pohl ..... E04B 1/34326 135/160
4,865,381 A * 9/1989 Van Rogue ..... A47C 7/66 297/184.15
5,000,210 A * 3/1991 Worthington, Jr. ..... A47C 7/66 135/90
5,013,085 A * 5/1991 Craig ..... A47C 1/143 297/184.15
5,033,528 A * 7/1991 Volcani ..... G11B 11/08 160/351
5,301,999 A * 4/1994 Thompson ..... A47C 7/66 297/184.13
5,441,067 A * 8/1995 James ..... A47C 7/66 135/96
5,611,380 A * 3/1997 Landy ..... E04F 10/02 160/76
5,722,477 A * 3/1998 Richter ..... A47G 5/00 160/135
5,758,889 A * 6/1998 Ledakis ..... B62B 9/14 280/47.38
5,769,556 A * 6/1998 Colley ..... B62H 3/02 403/396
5,967,601 A * 10/1999 Gillins ..... A47C 7/66 297/184.15
6,014,837 A * 1/2000 Morgan ..... A01G 13/0212 135/125
6,073,897 A * 6/2000 Warren ..... F16M 11/105 248/278.1
6,173,725 B1 * 1/2001 Garth ..... A47C 7/66 135/117
6,213,191 B1 * 4/2001 Nitzsche ..... A47B 83/001 108/50.11
6,413,004 B1 * 7/2002 Lin ..... B25B 7/02 403/171
6,698,966 B2 * 3/2004 Hilton ..... F16B 21/08 24/616
6,789,557 B1 * 9/2004 Wahl, Jr. ..... A47C 7/66 135/117
7,048,333 B2 * 5/2006 Martinez ..... A47C 7/66 135/126
7,063,481 B2 * 6/2006 Trull ..... A01G 9/16 403/170
7,165,762 B1 * 1/2007 Duzick ..... B25B 1/22 269/45
7,585,020 B1 * 9/2009 Wahl, Jr. ..... A47C 7/66 297/184.15
7,963,596 B2 * 6/2011 Efthimiou ..... A47C 7/66 297/184.11
8,157,394 B1 * 4/2012 Downing ..... G02B 5/08 359/868
8,225,723 B2 * 7/2012 Nakamura ..... A47B 17/00 108/50.01
8,387,330 B2 * 3/2013 Wallner ..... B27J 1/00 52/655.1
8,640,721 B2 * 2/2014 Mulligan ..... A01M 31/025 135/117
8,845,016 B2 * 9/2014 Domash ..... A47C 7/62 297/184.15
8,998,961 B1 * 4/2015 Ziemek ..... A61B 17/86 606/278
9,085,914 B1 * 7/2015 Kulm ..... A01M 31/025
9,220,347 B2 * 12/2015 Lovley, II ..... A47C 4/286
9,326,573 B1 * 5/2016 Harris ..... F16M 11/14
9,337,638 B2 * 5/2016 Trittschuh, III ..... H02G 7/00
9,383,113 B1 * 7/2016 Renwick ..... A47C 7/666
9,449,591 B2 * 9/2016 Domash ..... A47B 97/00
9,737,976 B2 * 8/2017 Christensen ..... B25B 5/163
9,930,434 B2 * 3/2018 Domash ..... A47B 97/00
9,936,811 B2 * 4/2018 Rowe, Jr. ..... A47C 7/66
9,970,212 B2 * 5/2018 Summers ..... A45B 23/00
10,307,893 B2 * 6/2019 Costen ..... B25B 5/101
D874,165 S * 2/2020 Hamilton ..... D6/332
11,046,162 B1 * 6/2021 Priebe ..... B60R 11/00
11,883,933 B1 * 1/2024 Goldheart ..... B25B 27/023
2003/0230326 A1 * 12/2003 Lin ..... A45B 11/00 135/20.1
2005/0006542 A1 * 1/2005 Henning ..... F16M 11/40 248/274.1
2006/0026806 A1 * 2/2006 Taylor ..... B60P 7/0807 24/489
2007/0144569 A1 * 6/2007 Fereghetti ..... F41H 3/02 135/90
2008/0042027 A1 * 2/2008 LaScala ..... B63B 17/04 248/229.15
2008/0129091 A1 * 6/2008 Sharapov ..... A47C 1/14 297/184.11
2008/0295301 A1 * 12/2008 Carnevali ..... F16M 13/022 24/569
2009/0025192 A1 * 1/2009 Roesch ..... B25B 5/102 24/522
2009/0049657 A1 * 2/2009 Lunder ..... E04F 10/0666 24/335
2009/0139669 A1 * 6/2009 Robin ..... A45B 23/00 160/351
2009/0151137 A1 * 6/2009 Darling, III ..... B62B 1/12 24/568
2010/0229355 A1 * 9/2010 Wang ..... F16B 2/10 24/489
2011/0048482 A1 * 3/2011 Yerian ..... E06B 9/24 135/125
2012/0211038 A1 * 8/2012 Pirshafiey ..... A47C 7/727 135/96
2013/0019912 A1 * 1/2013 Kennedy ..... A45B 23/00 135/16
2014/0026931 A1 * 1/2014 Lee ..... E05D 7/1055 135/144
2014/0091193 A1 * 4/2014 Simon ..... F16B 2/065 248/451
2014/0116632 A1 * 5/2014 Domash ..... A47C 7/62 160/369
2014/0209352 A1 * 7/2014 Trittschuh, III ..... H02G 7/00 174/135
2015/0016651 A1 * 1/2015 Domash ..... A47C 7/72 381/333
2015/0028639 A1 * 1/2015 Brown ..... B62B 9/108 297/184.13
2015/0263666 A1 * 9/2015 Powers, III ..... H02S 20/24 136/251
2017/0006367 A1 * 1/2017 Domash ..... E06B 9/00
2017/0009482 A1 * 1/2017 Remolina ..... A45B 21/00

* cited by examiner

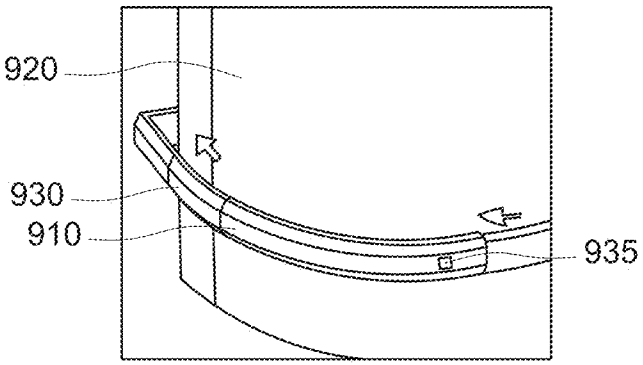
FIG. 13A2
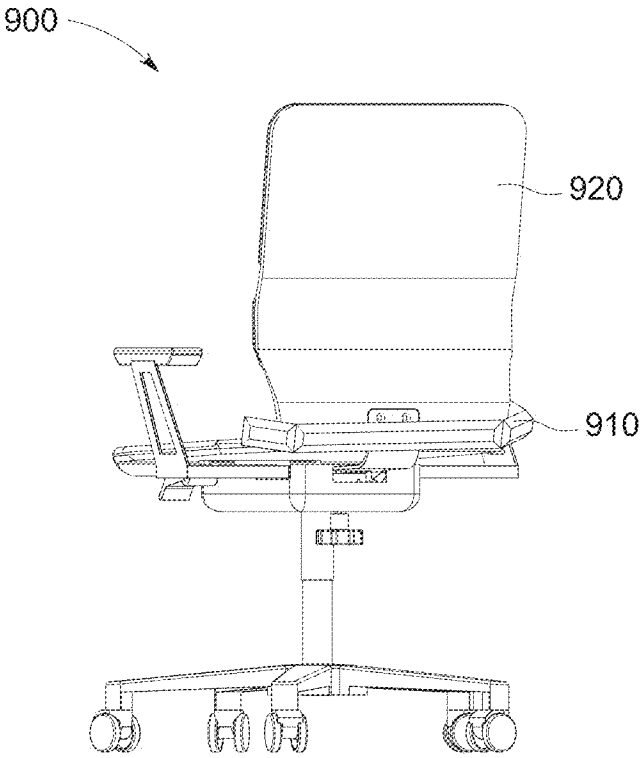
FIG. 13A1

RETROFITTING APPARATUS FOR A CHAIR THAT EXTENDS AROUND SIDES OF AN UPPER BODY PORTION OF A USER SEATED IN THE CHAIR

BACKGROUND

Some embodiments relate to a retrofitting apparatus for a chair that extends around sides of an upper body portion of a user seated in the chair so as to provide a physical barrier for the chair occupant. In particular, some embodiments are directed to methods and apparatus for enabling chairs to provide physical barriers between occupants seated therein and people, objects, etc., located adjacent thereto. Some other embodiments are directed to the entire chair itself, i.e., the combination of the chair and the apparatus that provides such physical barriers.

The related art includes chairs, such as for use in office or other professional environments, or other environments in which people gather. The related art chairs typically include a seat portion that extends substantially parallel to a surface (such as a floor) on which the chair is supported. Legs extend below the seat portion and are either directly or indirectly attached to the seat portion for supporting the seat portion on the surface. A back portion extends upwardly from the seat portion, and is typically configured to support at least a portion of a back of a user seated in the chair. In office environments, wheels are often connected to the bottoms of the legs to enable the chair to be easily movable along the surface, such as by rolling.

SUMMARY

The advent of open floor plans, such as in office or other environments, provides various advantages, but results in certain disadvantages, such as with regard to the privacy of the office occupants, which is especially poignant with regard to the ability of office occupants to maintain concentration, be susceptible to the transmission of germs and virus, etc. For example, related art chairs provide little or no privacy or barriers from other office occupants, such as those disposed immediately adjacent, i.e., at the sides of the chair occupant discussed above. Multiple people occupying such open floor plans and seated in the related art chairs are thereby susceptible to transmitting germs, virus, etc. Thus, some embodiments relate to a retrofitting apparatus for a chair that extends around sides of an upper body portion of a user seated in the chair so as to provide a physical barrier between the occupant and those disposed on either side thereof. Embodiments are intended to over any methods or apparatus for providing this physical barrier or protection. It is important to note that embodiments of the invention are intended to cover or otherwise include retrofitting apparatus (and the combination of chairs and retrofitting apparatus) for use with any type of chair and not just those used in office environments, such as those used in airports, on airplanes, automobiles, trains, restaurants, bars, and/or any other environment in which people gather. These barriers thereby impede or prevent the spread of germs, virus, etc., in such open floor plans occupied by multiple occupants.

One such exemplary embodiment is directed to retrofitting apparatus for use with a chair, the chair including a seat portion that extends substantially parallel to a surface on which the chair is supported, and a back portion that extends substantially perpendicular to the seat portion and away from the surface, the back portion being configured to support a portion of a back or a user seated in the chair, the chair also including at least one elongated connector that connects the seat portion and the back portion. The retrofitting apparatus includes a removable coupling structure connectable to the at least one elongated connector of the chair, the removable coupling structure including at least one connecting member configured to extend around a perimeter of a portion of the at least one elongated connector; and a cover connected to the coupling structure, the cover configured to project from at least a 180 degree radius around at least a portion of the back portion of the chair so as to extend around sides of the back of the user seated in the chair. Some embodiments include additional or alternative features to prevent the spread of germs or virus, such as anti-microbial, anti-bacterial and/or spandex fabric as chair cover configured to reduce or minimize the transmission of germs, virus, etc. and thereby protect occupants of the chair.

BRIEF DESCRIPTION OF THE DRAWINGS

Various exemplary aspects of the systems and methods will be described in detail, with reference to the following figures, wherein:

FIGS. 13A1-13F are diagrams illustrating a cover mounting assembly according to various exemplary embodiments;

FIG. 33 is a perspective view of the visual and/or acoustic privacy features illustrating the exemplary brackets for attachment to a desk via mechanical fasteners according to an exemplary embodiment;

DETAILED DESCRIPTION

Figure 1C:
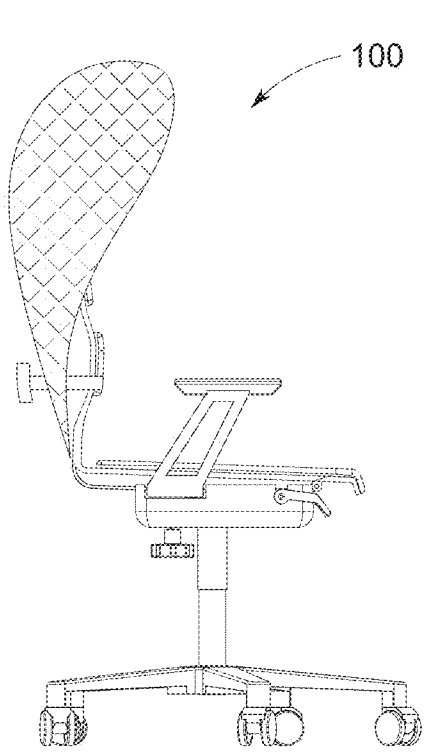
FIGS. 1A-1C are diagrams illustrating a universal chair mount assembly, according to various exemplary embodiments.

These and other features and advantages are described in, or are apparent from, the following detailed description of various exemplary embodiments.

It will be understood that when an element is referred to as being "on," "connected" or "coupled" to another element, it can be directly on, connected or coupled to the other element or intervening elements that may be present. In contrast, when an element is referred to as being "directly on," "directly connected" or "directly coupled" to another element, there are no intervening elements present. As used herein the term "and/or" includes any and all combinations of one or more of the associated listed items. Further, it will be understood that when a layer is referred to as being "under" another layer, it can be directly under or one or more intervening layers may also be present. In addition, it will also be understood that when a layer is referred to as being "between" two layers, it can be the only layer between the two layers, or one or more intervening layers may also be present.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of exemplary embodiments.

In the drawing figures, the dimensions of layers and regions may be exaggerated for clarity of illustration. Like reference numerals refer to like elements throughout. The same reference numbers indicate the same components throughout the specification.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For exemplary, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of exemplary embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments are described herein with reference to cross-sectional illustrations that are schematic illustrations of idealized embodiments (and intermediate structures) of exemplary embodiments. As such, variations from the shapes of the illustrations as a result, for exemplary, of manufacturing techniques and/or tolerances, are to be expected. Thus, exemplary embodiments should not be construed as limited to the particular shapes of regions illustrated herein but are to include deviations in shapes that result, for exemplary, from manufacturing. For exemplary, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of exemplary embodiments.

Unless otherwise defined, all terms (including technical and scientific terms) used herein have the same meaning as commonly understood by one of ordinary skill in the art to which exemplary embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein. As used herein, expressions such as "at least one of," when preceding a list of elements, modify the entire list of elements and do not modify the individual elements of the list.

When the terms "about" or "substantially" are used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%. Moreover, when the words "generally" and "substantially" are used in connection with geometric shapes, it is intended that precision of the geometric shape is not required but that latitude for the shape is within the scope of the disclosure. Although the tubular elements of the embodiments may be cylindrical, other tubular cross-sectional forms are contemplated, such as square, rectangular, oval, triangular and others.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions. The plurality of device structures may be integrated in a same electronic device. For exemplary, when a device structure (e.g., a memory cell structure or a transistor structure) is illustrated in a cross-sectional view, an electronic device may include a plurality of the device structures (e.g., memory cell structures or transistor structures), as would be illustrated by a plan view of the electronic device. The plurality of device structures may be arranged in an array and/or in a two-dimensional pattern.

Reference will now be made in detail to embodiments, exemplarys of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain exemplary embodiments of the present description.

Figure 1B:
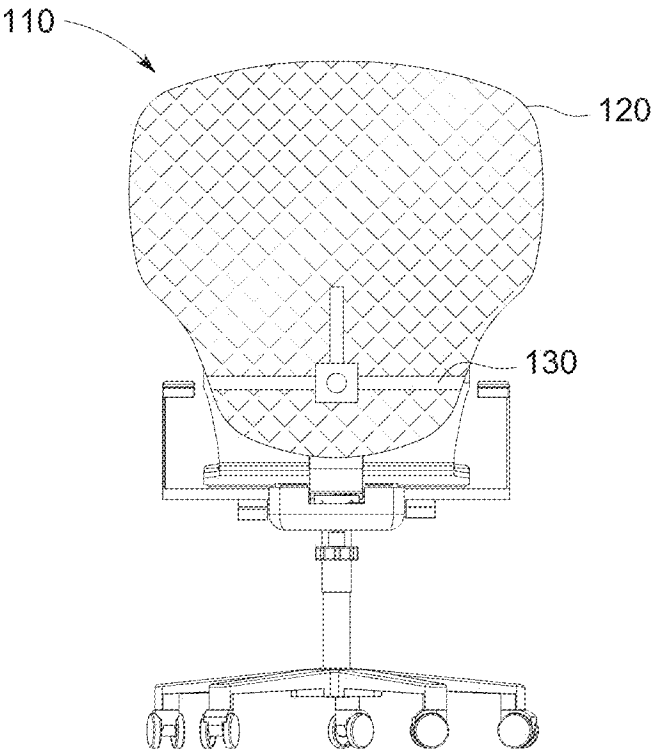
Figure 1A:
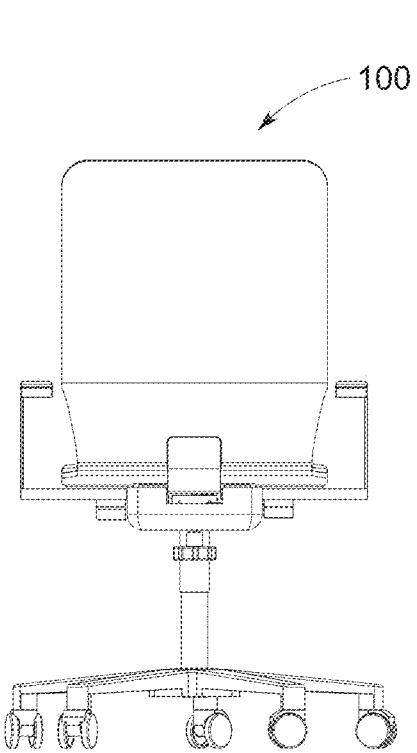

FIGS. 1A-1C are diagrams illustrating a universal chair mount assembly, according to various exemplary embodiments. In FIG. 1A, a chair 100 is illustrated. In exemplary embodiments, the chair 100 may be a chair typically commercially available for use in various environments, such as in a professional office. FIG. 1B illustrates an attachment kit 110 including retrofit "wings" 120 and a universal mount 130. In exemplary embodiments, the kit be configured to attach the universal mount 130 using the brand/model specific hook/straps to the seat back of the chair 100, and orient the wings 120 retrofit to be at the proper height on chair 100. Exemplary embodiments cover any mechanism or method for attaching the universal chair mount assembly to the chair, and in particular to attach the wings 120 to any portion of the chair 100. In exemplary embodiments, if straps are required, there could be a chair specific 'glove' that fits over the chair back. FIG. 1C illustrates the chair 100 and retrofitting apparatus from a side view.

Figure 2:
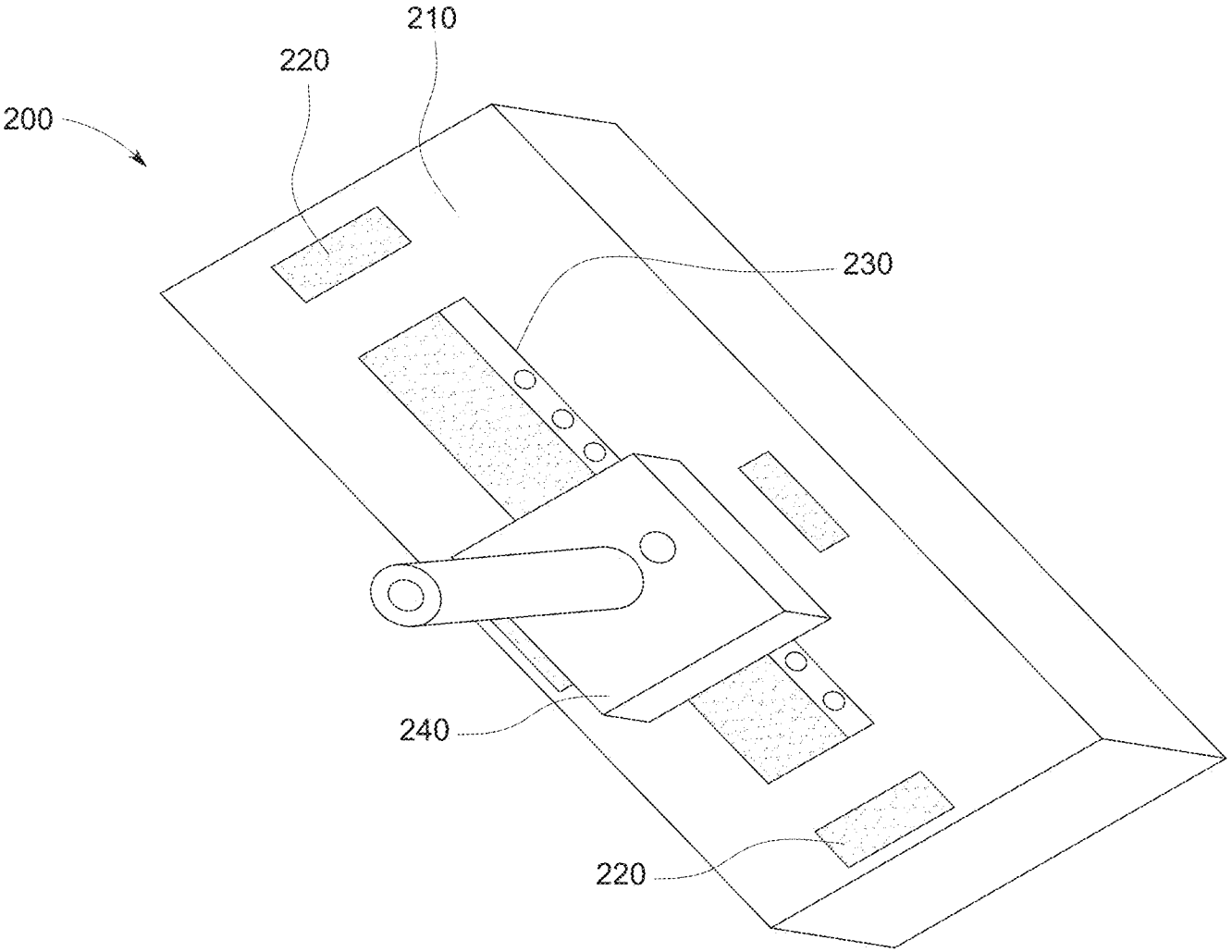
FIG. 2 is a diagram illustrating a mounting bracket, according to various exemplary embodiments.
Figure 3C:
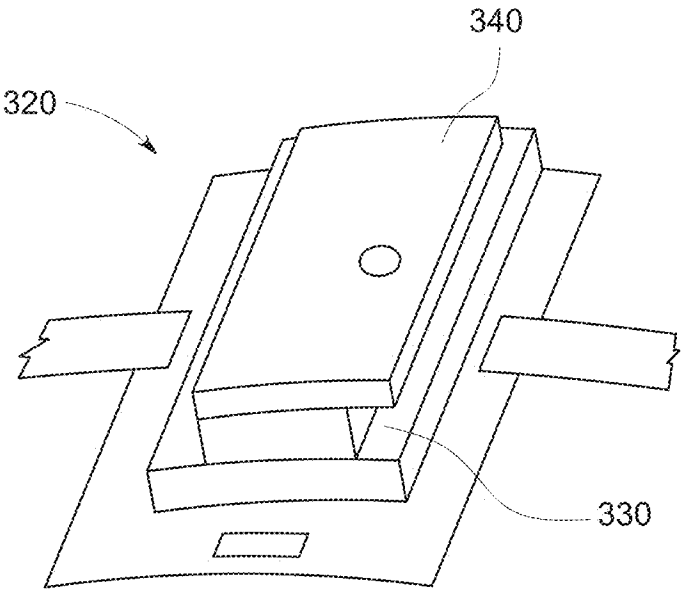
FIGS. 3A-3C are diagrams illustrating a chair frame attachment, according to various exemplary embodiments.
Figure 3B:
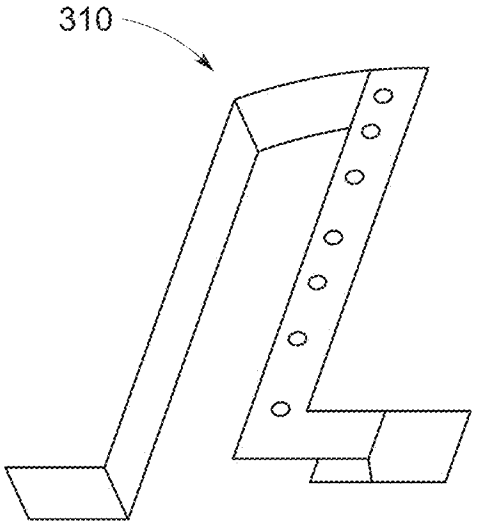
Figure 3A:
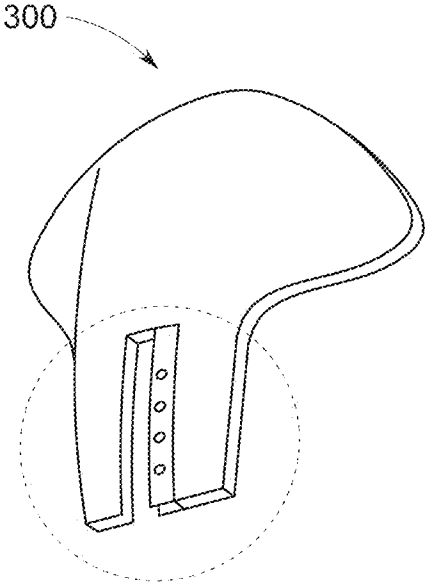

FIG. 2 is a diagram illustrating a mounting bracket 200, according to various exemplary embodiments. In FIG. 2, the larger metal casing 210 includes slots 220 to allow for straps to be passed through and secure the mounting bracket 200 to the back of a chair such as, e.g. chair 100 illustrated in FIGS. 1A-1C. In addition, in exemplary embodiments, the larger metal casing 210 includes a center slot 230 defining a path along which a slide 240 can be adjusted, the slide 240 being configured to attach the metal casing 210 to the chair 100. In exemplary embodiments the slide 240 may be configured to secure the mounting bracket 200 to the back of the chair 100 at the appropriate height. Alternatively, a ball joint may be used instead of the slot FIGS. 3A-3C are diagrams illustrating a chair frame attachment, according to various exemplary embodiments. FIGS. 3A-3C illustrate, in exemplary embodiments, a chair attachment 300 similar to, e.g., the wings 120 discussed above, including a slot 310 configured to allow a mounting bracket 320, to slide therein. In exemplary embodiments, the mounting bracket 320 includes a recess 330 configured to slide into the slot 310 formed in the back of, e.g., the chair 100 discussed above. In exemplary embodiments the mounting bracket 320 includes a pin 340 configured to enables mounting of the bracket 320 onto the back of the chair at a desired height. In exemplary embodiments, the bracket 320 may include two pin tracks instead of one, and the mounting bracket 320 may be configured to be tilted so as to achieve a desired angle of retraction of the chair back.

Figures 4A, 4B:
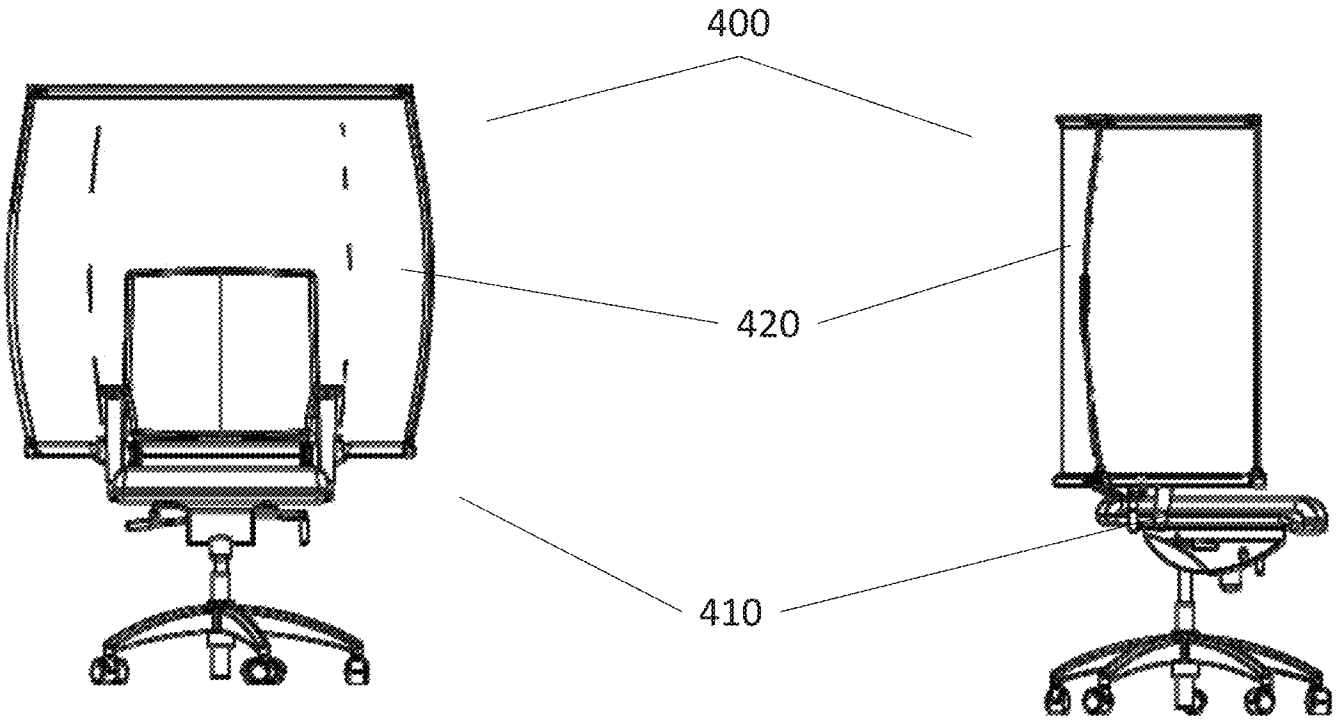
FIGS. 4A-4B are diagrams illustrating a chair assembly according to various exemplary embodiments.

FIGS. 4A-4B are diagrams illustrating a chair assembly according to various exemplary embodiments. In FIG. 4A, the chair assembly 400 includes a chair 410 and a mounted attachment 420. In exemplary embodiments, the mounted attachment 420 include anti-microbial, anti-bacterial and/or spandex material configured to inhibit or reduce the transmission of a contagious virus. In exemplary embodiments, the mounted attachment 420 may include, e.g., the wings 120 discussed above.

Figure 5B:
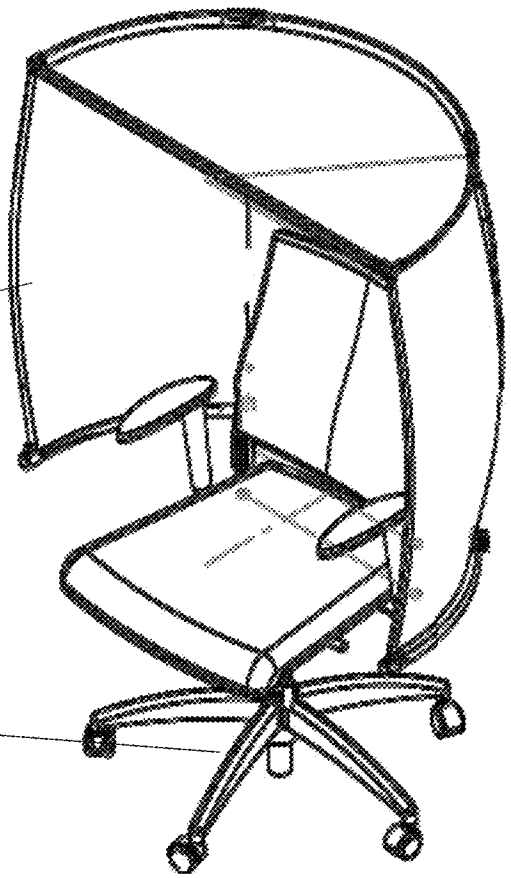
FIGS. 5A-5D are diagrams illustrating a chair assembly according to various exemplary embodiments.
Figure 5A:
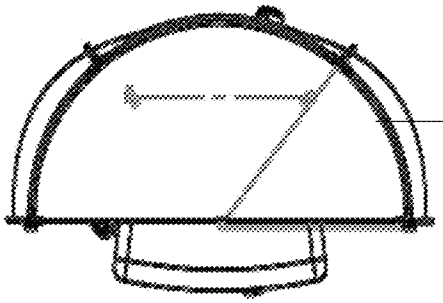
Figure 5D:
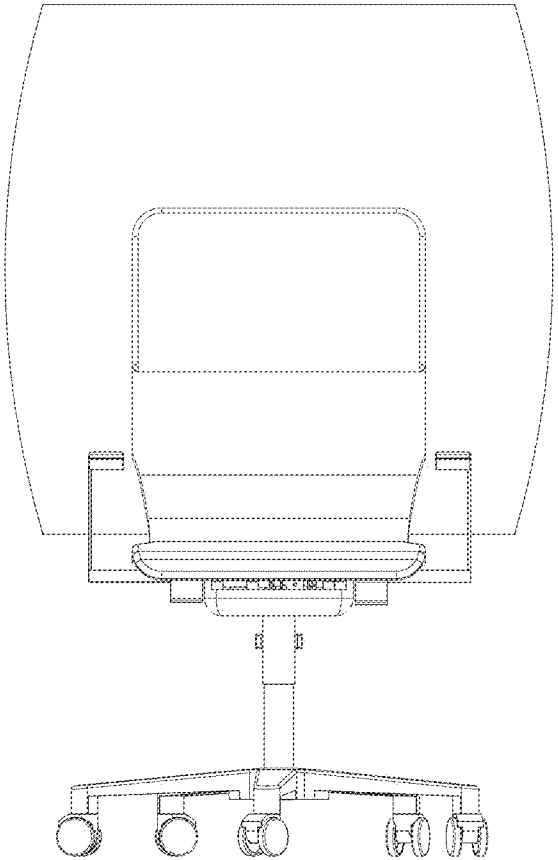
Figure 5C:
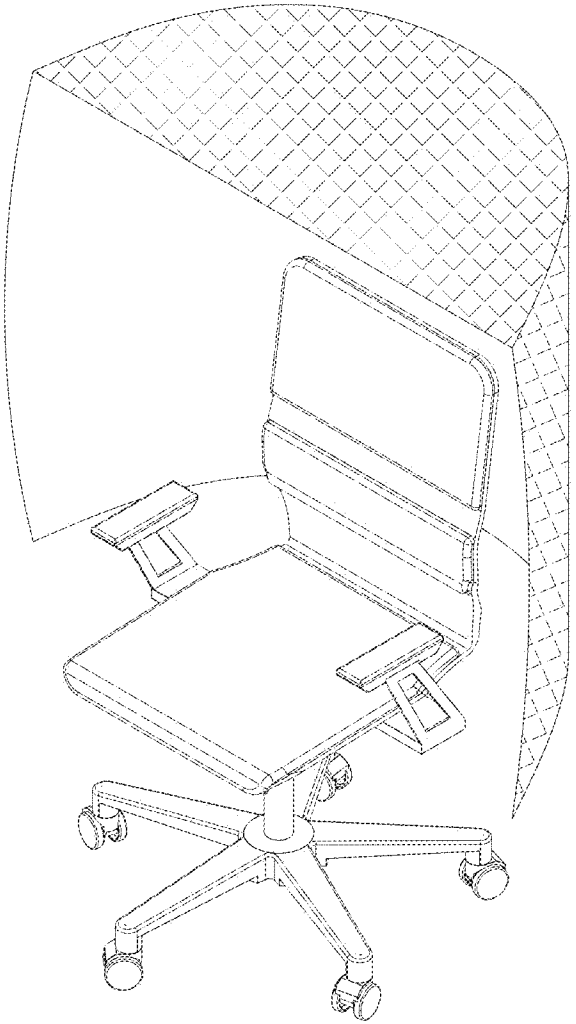

FIGS. 5A-5D are diagrams illustrating a chair assembly according to various exemplary embodiments. FIG. 5A is a top view of the chair assembly 500, and FIG. 5B is a front view of the chair assembly 500. In exemplary embodiments, the chair assembly 500 includes a chair 510 and a mounted attachment 520. In exemplary embodiments, the mounted attachment 520 is configured as so to three-dimensionally surround the chair 510 and provide all-around protection for a person sitting on the chair 510. In exemplary embodiments, the mounted attachment 520 include anti-microbial, anti-bacterial and/or spandex material configured to inhibit or reduce the transmission of a contagious virus. In exemplary embodiments, the mounted attachment 520 may include, e.g., the wings 120 discussed above. In exemplary embodiments, the mounted attachment 520 extends circumferentially or semi-circumferentially around the chair 510 so as to surround a person sitting on the chair 510 from the back and the sides, leaving an opening in the front for the person to use the chair and meet with other people or work on a desk or computer. FIGS. 5C and 5D are illustrations of FIGS. 5A and 5B, respectively.

A greater description and discussion of shrouded chairs is provided below.

The use of reclining seats has been well known for many years. The popularity of reclining seats is evident given their extensive domestic or household use as well as commercial applications such as in movie theaters, public viewing arenas or any applicable location wherein the occupant of the chair structure is expected to be seated for a relatively long period of time. In the area of air travel, both commercial aircraft and private multi-passenger aircraft have adapted almost exclusively the use of reclining seat structures for passengers during travel. In the aircraft industry, such chair structures must meet certain strength and crash requirements of the Federal Aviation Administration (FAA), while at the same time it is, of course, highly desirable that a certain amount of comfort be available to the occupant, especially when travelling relatively long distances. However, because of the space requirements and the necessity, particularly in commercial airlines, to increase the passenger load, the use of reclining seats or chair structures has been somewhat limited to the structures which only recline a relatively small or minimal amount. Also, when the passenger is trying to rest or even sleep in such a reclined position there is almost a total lack of privacy because of the closeness of the next adjacent passenger. Also, because of the space requirements there is almost a complete lack of any type of structure which would at least partially enclose the passenger during periods of rest or sleep to increase his privacy. The above situation exists even in so-called "first class" portions of the passenger cabins wherein more space is allotted on a per passenger basis because of the higher prices charged passengers for traveling in such areas. However, there are still no devices which are commonly used in such portions of the passenger cabin which are specifically designed to increase the privacy of individual passengers by shielding or segregating them from surrounding passenger areas particularly during desired rest periods.

Therefore, it may be advantageous to have an assembly which is specifically designed to allow or define an area of increased privacy for each passenger or occupant, particularly when such passenger assumes a reclined position for resting or sleep. An exemplary privacy structure would adequately and efficiently segregate at least a portion of the passenger's body from surrounding passengers in a manner which will not only increase his privacy but block or at least restrict his exposure to ambient light during rest periods. Naturally, the structure of such an improved privacy increasing assembly should have sufficient structural integrity to meet all FAA strength requirements, while also being perfectly safe when used in combination with any type of fully reclining seat structure, so as to ensure and maintain the safety of an occupant or passenger during all phases of operation of an aircraft or any other vehicle. In addition, such an exemplary or improved assembly to increase the privacy of individual passengers should be dimensioned and configured to at least partially surround the passenger or occupant of the seat structure when the seat structure is in a fully reclined position. Accordingly, the structure of any type of exemplary privacy assembly should be specifically adapted for use in combination with a chair structure which has the capability of being fully reclined so that the passenger or occupant may assume a substantially horizontal position for best facilitating rest or sleep over long periods of time.

Exemplary embodiments include a privacy shroud assembly designed to be used in a manner which increases or ensures a certain amount of privacy to an occupant of a chair structure, when the chair structure is disposed in a reclined position. The privacy shroud assembly of the present invention is particularly adapted for use on aircraft and, particularly, both aircraft associated with commercial airline use as well as multi-passenger private aircraft. More specifically, the privacy shroud assembly of the present invention includes a base portion fixedly secured to the floor of the aircraft or other support surface on which a correspondingly positioned chair structure is mounted. The base portion is disposed in immediately adjacent or at least partially surrounding relation to opposite sides and generally the rear area portion of the chair structure. An exemplary privacy shroud assembly further includes a shield portion which is selectively positionable relative to the base portion between a stored position and an operative position. The shield portion includes spaced apart, oppositely disposed, side walls disposed in generally parallel relation to one another. An end portion extends between corresponding ends of the sidewalls in interconnecting relation thereto. The shield portion further includes an open top and an open front end. These openings are dimensioned and configured so as to allow the extension therethrough of portions of the chair structure depending upon the particular position or attitude assumed by the chair structure.

The stored position of the shield portion is defined by a somewhat surrounding relation to the base portion and to a seat or lower end of the chair structure. Also, when the shield portion is in the stored position it assumes a low profile position which promotes unobstructed views of the passenger and facilitates talking or communication of the passenger with others. In addition, no vertical cabin space above the passenger is utilized when the shield portion is in the low profile position. The shield portion is movably coupled to the base portion so as to be positionable relative thereto into the aforementioned operative position. Such operative position may be further defined by an upward and somewhat outward or rearward disposition of the shield portion relative to the base and what may be considered a rear portion of the chair structure. In such position, it is disposed to at least partially surround the backrest of the chair structure when such backrest is in preferably a fully reclined position itself being defined by a somewhat horizontal orientation.

Additional structural features of the subject privacy shroud assembly include a cover assembly which may be movably mounted on the shield portion and selectively positionable between an open position and a closed position relative to the open top area of the shield assembly. When in the closed position, the cover assembly serves to at least partially close the open top of the shield portion and somewhat overlie or cover the upper torso portion of an occupant of the chair structure when the backrest is in its reclined position. The cover assembly may include a variety of different cover structures such as a flexible material cover structure which is rolled upon itself while being stored. Ultimately, a flexible material sheet may be selectively positionable along some type of supporting attachment so that, as set for above, this flexible sheet may be disposed in a closed relation to the open top of the shield portion thereby serving to provide privacy as well as restrict or completely block the ambient light from entering the area occupied by the passenger of the chair structure.

Figure 8:
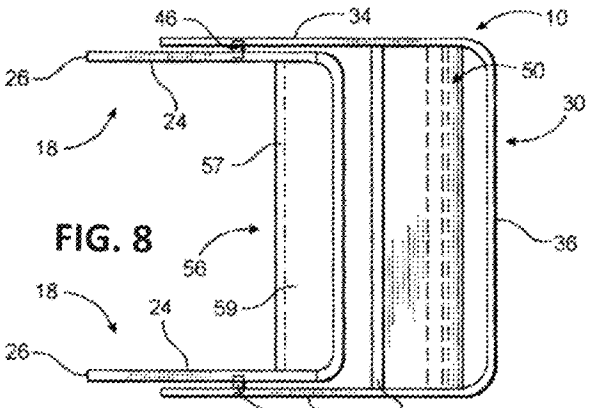
FIG. 8 is a top view of a privacy shroud structure.
Figure 6:
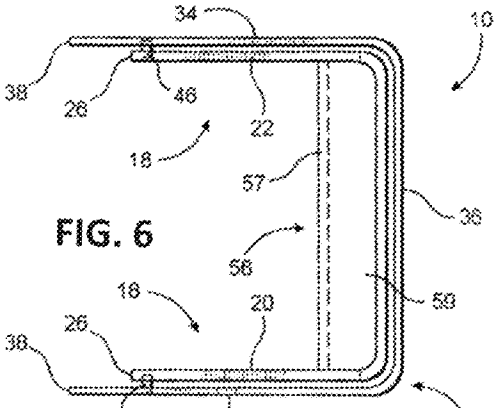
FIG. 6 is a top view of the privacy shroud assembly.
Figure 9:
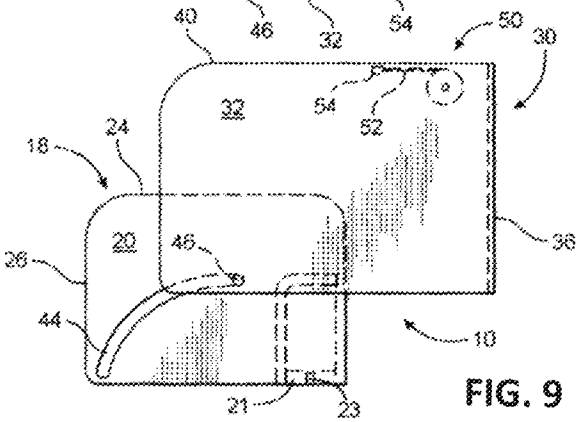
FIG. 9 is a side view of the embodiment shown in FIG. 5.

With regard to FIGS. 6-9, the shield portion 30 is movably coupled to the base 18 such that the shield portion 30 may be selectively positionable between the stored position (FIGS. 6 and 7) and the operative position (FIGS. 8 and 9). In the stored position, the shield portion 30 somewhat surrounds and is located outboard of the base 18. Their correspondingly or generally similar configurations allow for a compact mutual positioning of both the base 18 and shield portion 30 when in the aforementioned stored position. Further, in this stored position both at least partially surround a lower or seat portion 13 of the chair structure 12. Also, when the shield portion is in the stored position it assumes a low profile position which promotes unobstructed views of the passenger and facilitates talking or communication of the passenger with others. In addition, no vertical cabin space above the passenger is utilized when the shield portion is in the low profile position.

When the shield portion 30 is moved to its operative position it assumes an upward and substantially outward or rearward orientation relative to base portion 18 and seat structure 12, as shown in FIG. 9. In such a position the backrest 14 may be disposed in its fully reclined position so as to provide, at least in part, a substantially horizontally oriented support surface on which a passenger or occupant may comfortably recline. Relative movement of the shield portion between its stored position and operative position is accomplished by a track assembly 44 including, in an exemplary embodiment, one track each formed in or at least on the outermost surface of the opposite side panels 20 and 22 (See FIGS. 7 and 9). These track structures 44 include a somewhat arcuate or curvilinear configuration such that a coupling member as at 46 formed on the inside surface of both of the side panels 33 and 34 of the shield portion 30, may be disposed and dimensioned to travel, in a sliding relation within the correspondingly positioned track structures 44. The overall configuration, as set forth above, allows an exemplary orientation of the shield portion 30 to freely travel selectively between the stored position and operative position. Once in its operative position, the overall configuration of the shield portion 30 is such as to at least partially surround the backrest 14 when it is in its fully reclined position. This, of course, greatly increases segregation of the occupant lying on the backrest 14, from surrounding passengers or passenger areas. The positioning of the shield portion 30 may be accomplished manually as by mechanically moving it between the stored and operative positions. Alternately, electronic control means including appropriate structural linkage may be utilized and be accessible to the passenger for selective positioning of the shield portion 30.

An exemplary embodiment includes a cover assembly including, in one exemplary embodiment, a cover structure generally indicated as 50. The cover structure 50 includes a cover element 52 which preferably is formed of a flexible, somewhat resilient and light impermeable material. This cover element 52 may be extended from its stored or rolled position to an outwardly extending position partially represented in FIG. 8. In such a position the leading edge 54 and a remainder of the cover element 52 may extend completely or at least partially across the open top 40 of the shield portion so as to somewhat overlie and at least partially cover the backrest 14 and any person reclined thereon. Also, the positioning of the cover element 52 in the outwardly extended or closed position relative to the open top 40 will allow light to be blocked or restricted from entering into the area occupied by the backrest 14 and any occupant thereon.

Yet additional structural features of exemplary embodiments include a support structure 56 mounted somewhat on the interior of the base 18 and fixedly secured thereto. This support structure 56 includes an upper plate 59 and a supporting wall as at 57. The plate 59 is located at a height sufficient to supportingly engage the rear surface of the backrest 14 when it is in its reclined position. When in such position, additional weight would be placed thereon by the presence of an occupant or passenger. Accordingly, the presence of the support structure 56 is such as to provide adequate support as clearly shown.

Other structural features particularly relating to the chair structure 12 include the presence of either a footrest 72 or ottoman type structure generally indicated as 70. Alternately, when room for such an ottoman 70 does not exist a footrest as at 72 may be provided which selectively assumes an outwardly extending position on which the feet of an occupant can rest when the backrest is in the fully reclined position. Since many modifications, variations and changes in detail can be made to the described exemplary embodiment of the invention, it is intended that all matters in the foregoing description and shown in the accompanying drawings be interpreted as illustrative and not in a limiting sense.

Figure 10B:
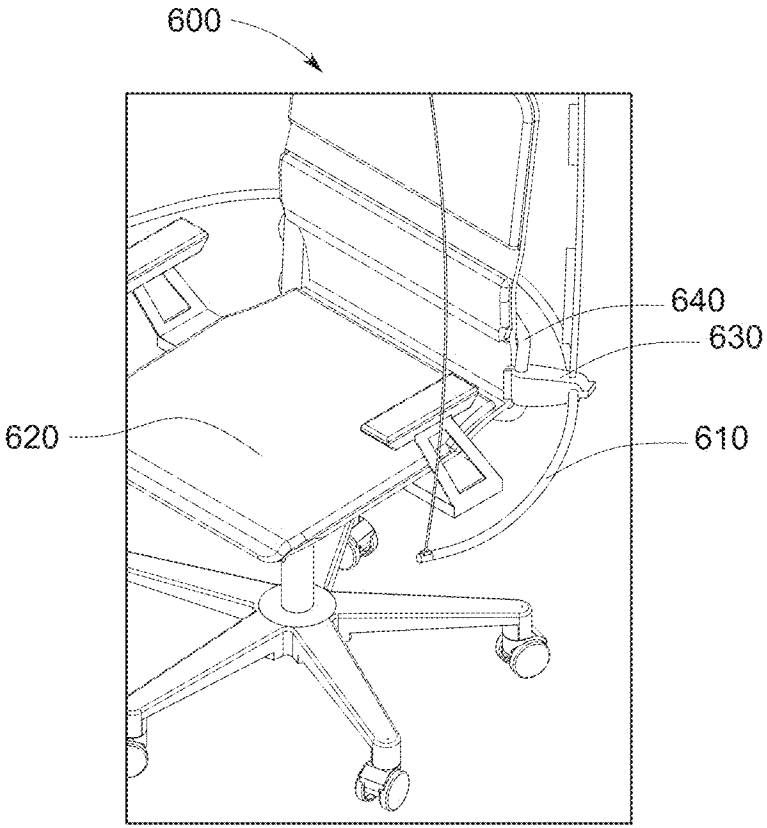
FIGS. 10A-10B are diagrams illustrating a chair assembly according to various exemplary embodiments.
Figure 10A:
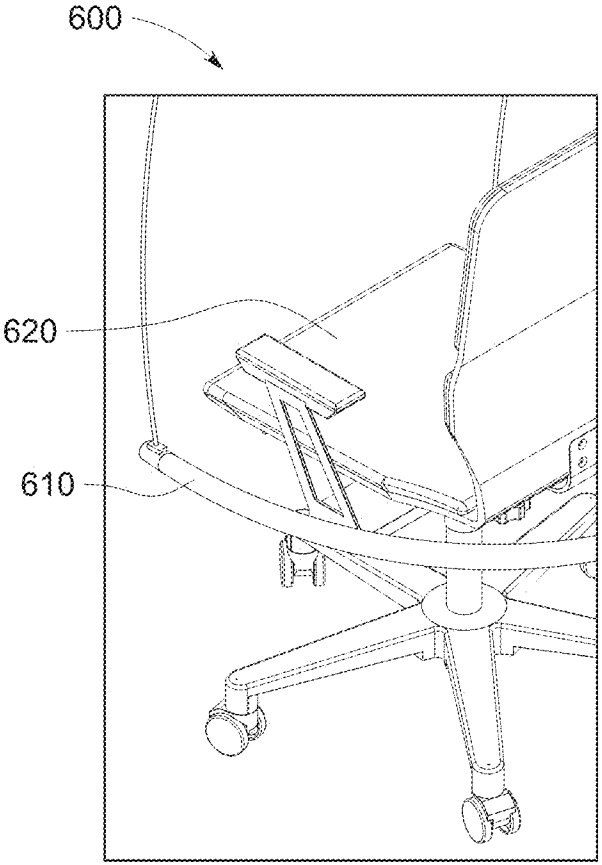

FIGS. 10A-10B are diagrams illustrating a chair assembly according to various exemplary embodiments. In FIG. 10A, the chair assembly 600 includes a support member 610 rigidly coupled to the chair 620 via one or more mounting brackets 630. In exemplary embodiments, the support member 610 is a longitudinal rod, shaft, or bar, extending substantially circularly around the base of the chair assembly 600. In exemplary embodiments, the one or more mounting brackets 630 are configured to fix the support member 610 in space with respect to the chair 620. In exemplary embodiments, the support member 610 may provide support for a cover such as, e.g., the wings 120 discussed above. In exemplary embodiments, as the chair 620 is secured to one end of the mounting bracket 630, the support member 610 may be secured to the opposite end of the mounting bracket 630. As a result, a secure chair assembly 600 may be formed, providing support for a cover such as, e.g., the wings 120 discussed above. In exemplary embodiments, one end of the mounting bracket 630 includes an opening configured to receive therein a generally vertically formed frame member 640 of the chair 620. An opposite end of the mounting bracket 630 includes an opening configured to receive the support member 620.

Figures 11A, 11B:
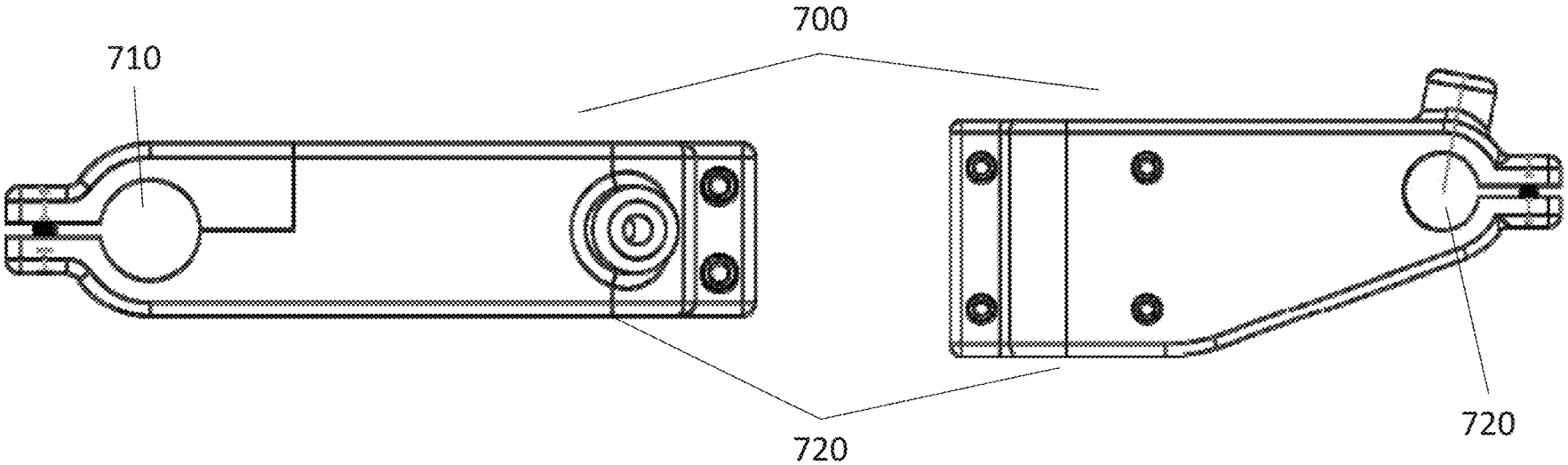
FIGS. 11A-11Q are diagrams illustrating a clamp attachable to a chair frame, according to various exemplary embodiments.
Figures 11C, 11D:
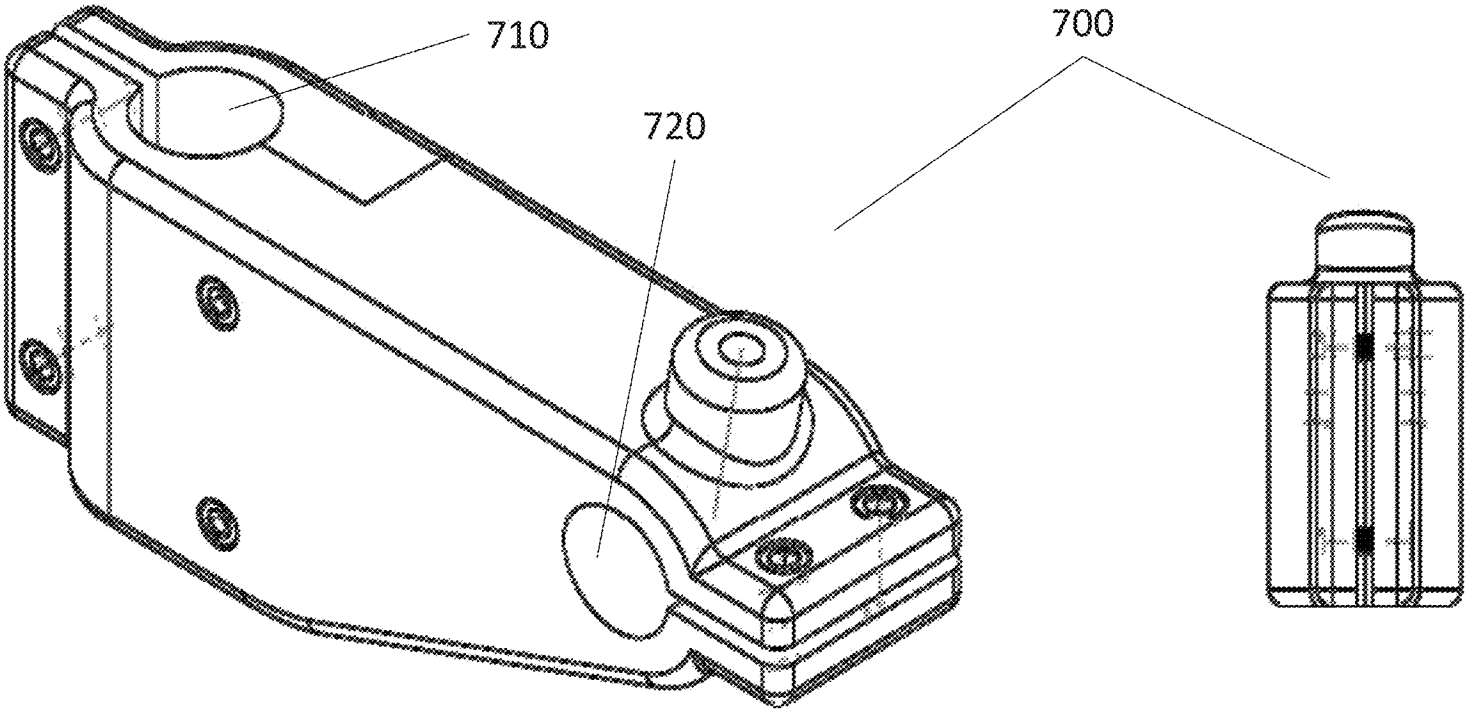
Figures 11E, 11F:
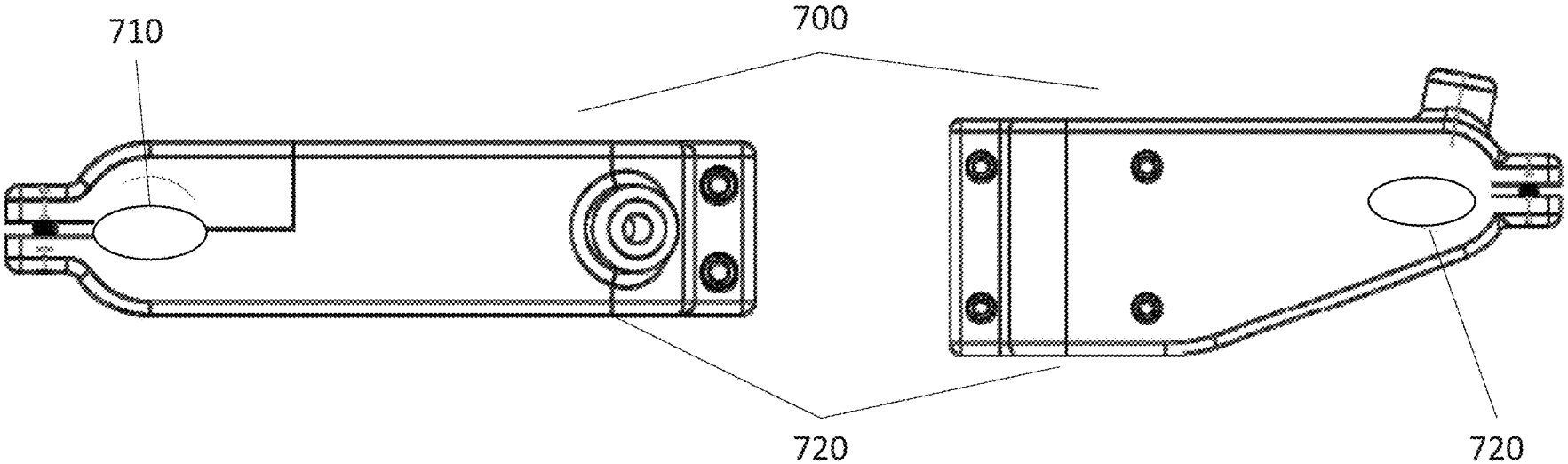
Figures 11G, 11H:
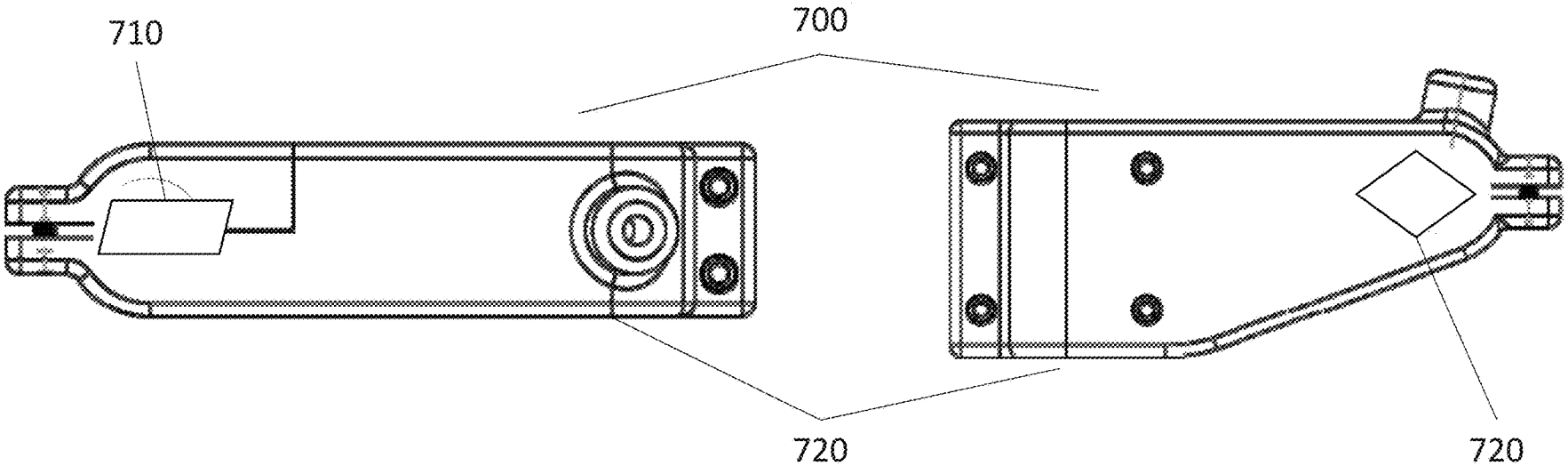
Figures 11I, 11J:
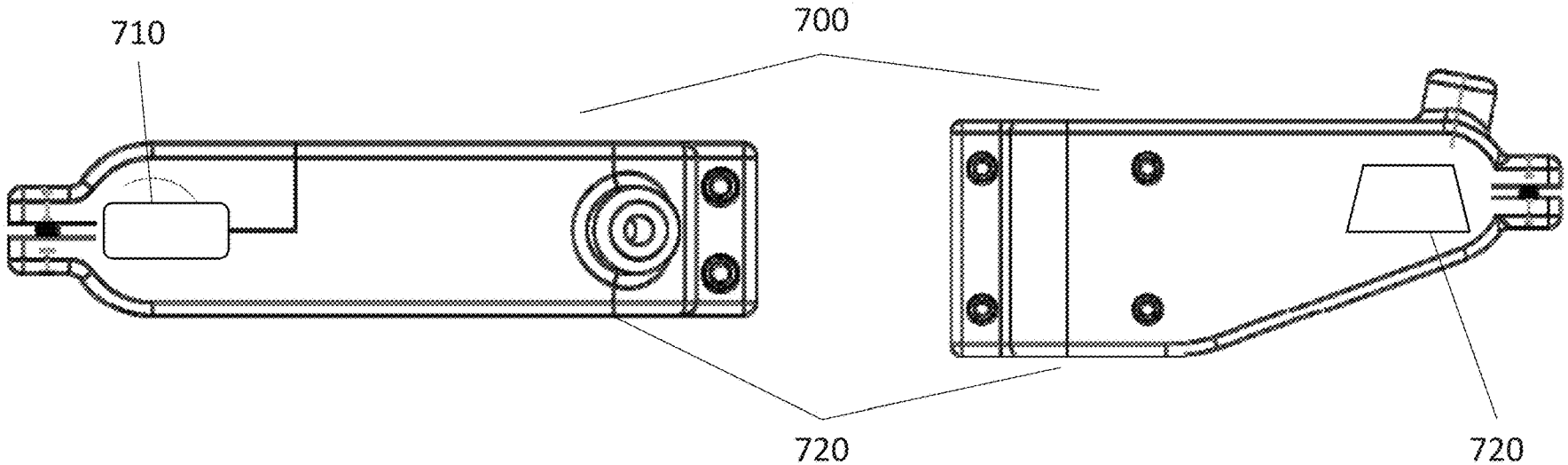
Figures 11K, 11L:
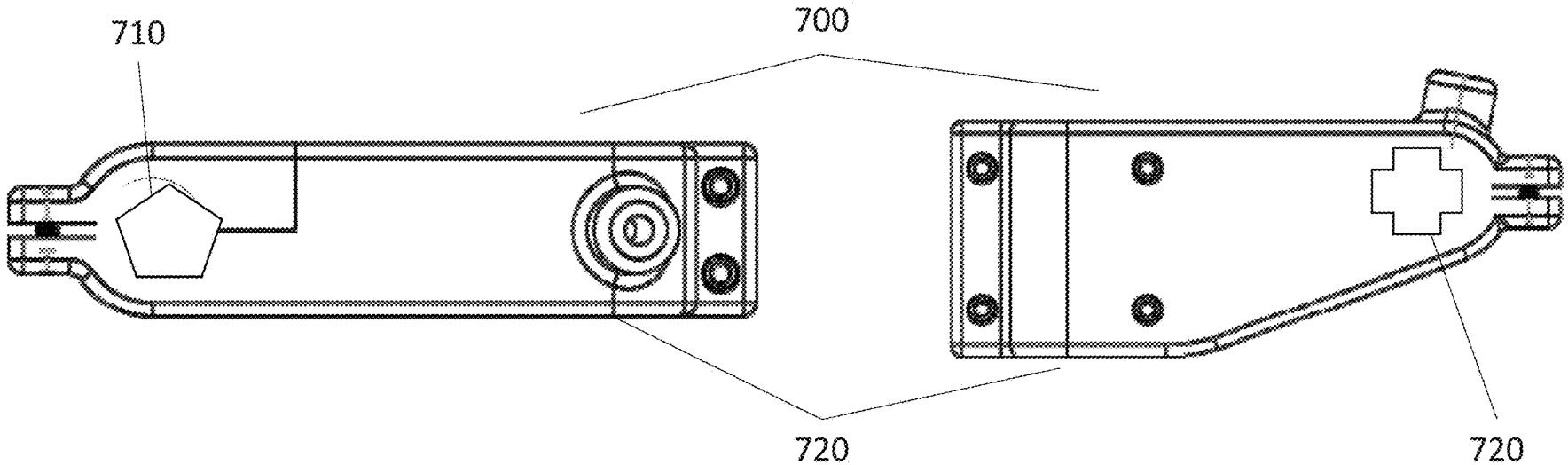
Figure 11N:
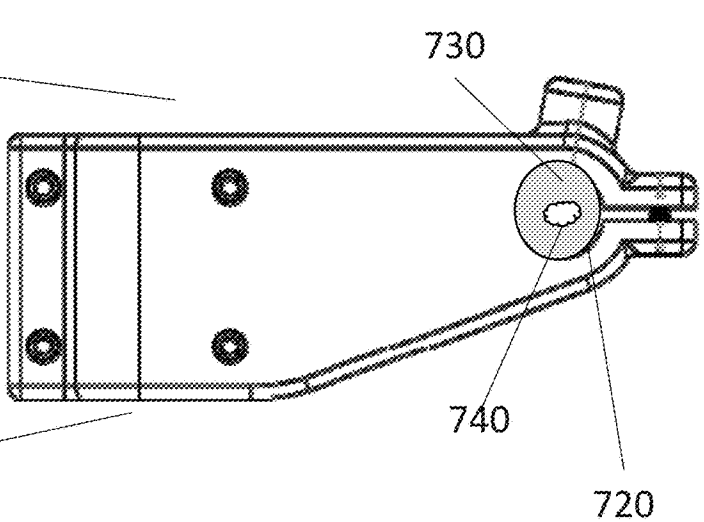
Figure 11M:
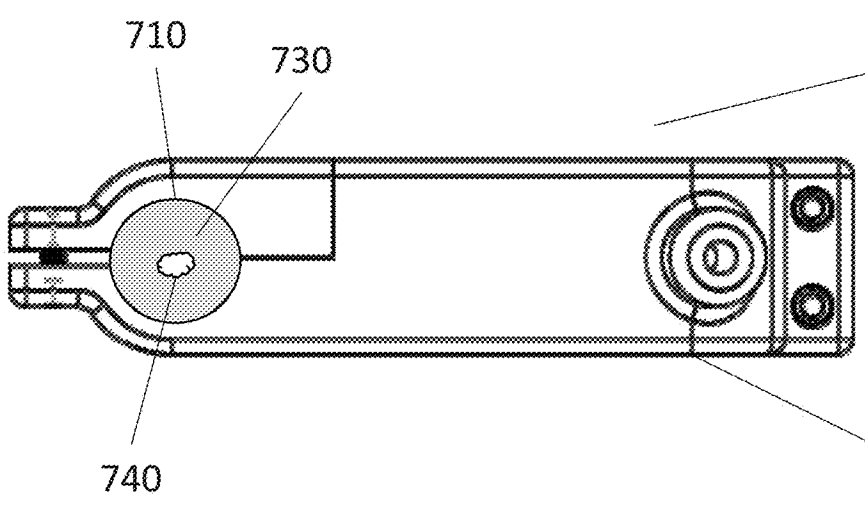
Figure 11P:
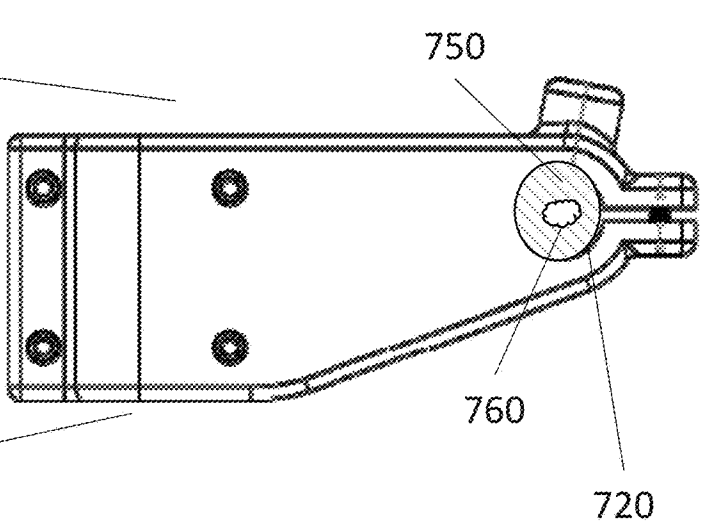
Figure 11O:
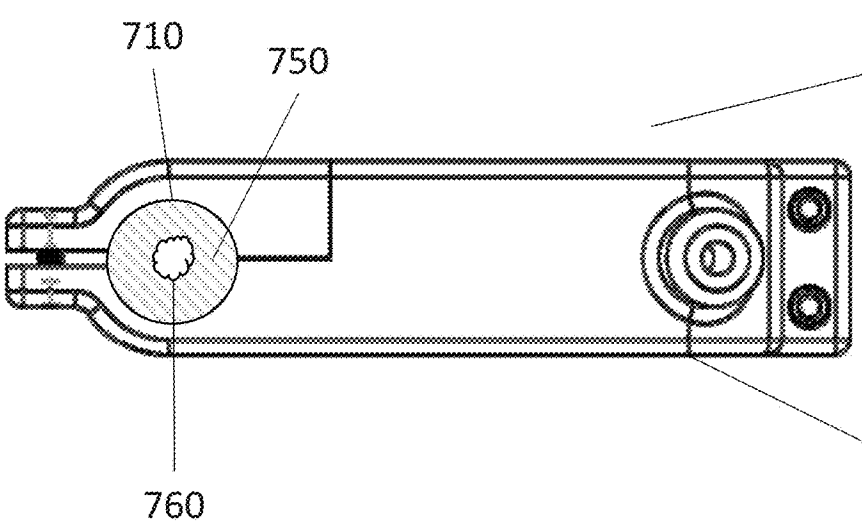
Figure 11Q:
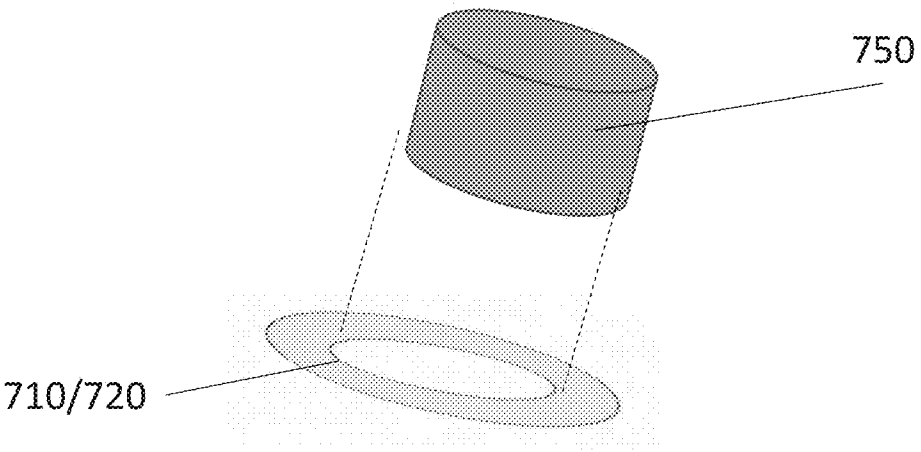

FIGS. 11A-11Q are diagrams illustrating a clamp attachable to a chair frame, according to various exemplary embodiments. In FIGS. 11A-11D, in exemplary embodiments, the mounting bracket 700, similar to, e.g., the mounting bracket 630 discussed above, includes a through-hole or opening 710 at one end thereof, the through-hole or opening 710 being configured to receive a frame member of the chair therein such as, e.g., the generally vertically formed frame member 640 discussed above. In exemplary embodiments, the mounting bracket 700 includes another through-hole or opening 720, at an opposite end thereof from through-hole or opening 710, configured to receive a support member such as, e.g., the support member 620 discussed above.

FIGS. 11E-11L are diagrams illustrating various shapes for the through-holes or openings 710 and 720 and corresponding to various shapes of the frame member of the chair 640 discussed above and of the support member 620, according to various exemplary embodiments. For exemplary, the frame member 640 of the task chair may have a variety of cross-sectional profiles such as, for exemplary, oval, lozenge, parallelepiped, rectangular, fractal, and many more shapes and cross-sectional profiles and the like. FIGS. 11E-11L provide a few exemplarys of such cross-sectional profiles, but the various embodiments are not limited to the disclosed cross-sectional profiles. In exemplary embodiments, although FIGS. 11E-11L show that the through-holes or openings 710 and 720 have specific cross-sectional profiles, these cross-sectional profiles are exemplarys only, each of the through-holes or openings 710 and 720 may any of the cross-sectional profiles depicted in FIGS. 11E-11L, and each of the through-holes or openings 710 and 720 may have the same or a different cross-sectional profile as the other through-hole or opening.

FIGS. 11M-11N are diagrams illustrating the through-holes or openings 710 and 720 including a soft material 730 configured to conform to the shape of the cross-sectional profile of any one of the support member 620 and the frame member 640. Accordingly, the clamp 700 may attach to any cross-sectional profile of the support member 620 and/or the frame member 640. In exemplary embodiments, the material 730 forming the interior of the through-holes or openings 710 and/or 720 may consist of or include memory foam material such as silicone rubber, an polymeric material having sufficient elasticity to conform to the cross-sectional profile of the support member 620 and/or the frame member 640 and form a rigid snug fit sufficiently strong to rigidly attach the clamp 700 to the support member 620 and/or the frame member 640. In exemplary embodiments, the material 730 forming the interior of the through-holes or openings 710 and/or 720 may also consist of or include any non-polymeric material having sufficient elasticity to conform to the cross-sectional profile of the support member 620 and/or the frame member 640 and form a snug fit sufficiently strong to rigidly attach the clamp 700 to the support member 620 and/or the frame member 640. In exemplary embodiments, the soft material 730 may include a small through opening 740 configured to allow the support member 620 or the frame member 640 to pass through, and to allow the soft material 730 to rigidly snugly fit the support member 620 and/or the frame member 640 to the clamp 700.

FIGS. 11O-11P are diagrams illustrating the through-holes or openings 710 and 720 each including a rigid insert 750 configured to conform to the shape of the cross-sectional profile of any one of the support member 620 and the frame member 640. Accordingly, the clamp 700 may attach to any cross-sectional profile of the support member 620 and/or the frame member 640 provided that the appropriate insert 750 is placed in the through-hole or opening 710 and/or 720. In exemplary embodiments, the insert is rigidly attached to the inside rim of the through-hole or opening 710 and/or 720 via a snug fit to the inside perimeter of the through-hole or opening 710 and/or 720. In exemplary embodiments, the insert 750 also rigidly encompasses the support member 620 and/or the frame member 640 so as to rigidly secure the clamp 700 to the support member 620 and/or the frame member 640. In exemplary embodiments, the insert 750 includes an through-hole or opening configured to accommodate the support member 620 or the frame member 640 to pass through, and to allow the insert 750 to rigidly snugly fit the support member 620 and/or the frame member 640 to the clamp 700. FIG. 11Q illustrates a rigid insert 750 fitting snugly in the through-hole or opening 710 and/or 720, according to various exemplary embodiments.

Figure 12C:
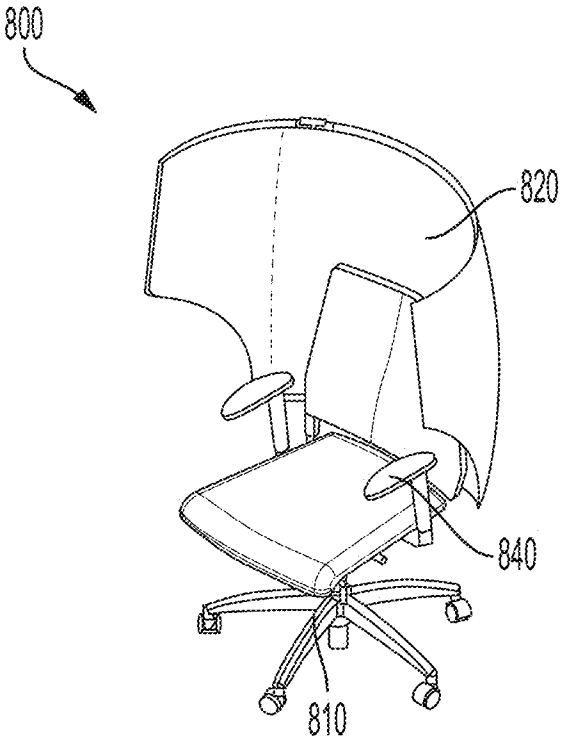
FIGS. 12A-12C are diagrams illustrating a chair assembly according to various exemplary embodiments.
Figure 12B:
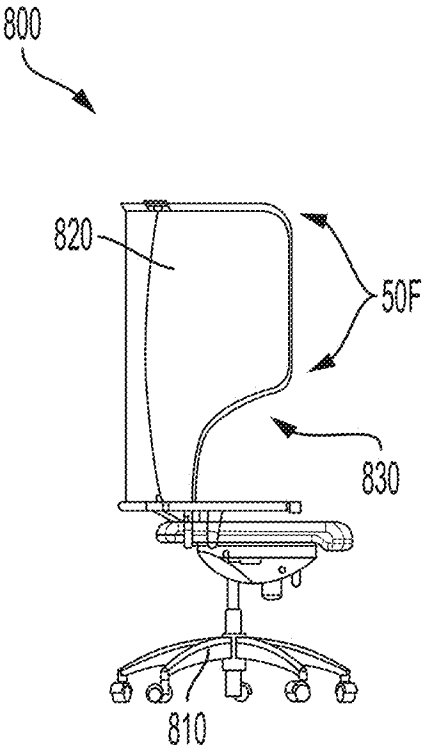
Figure 12A:
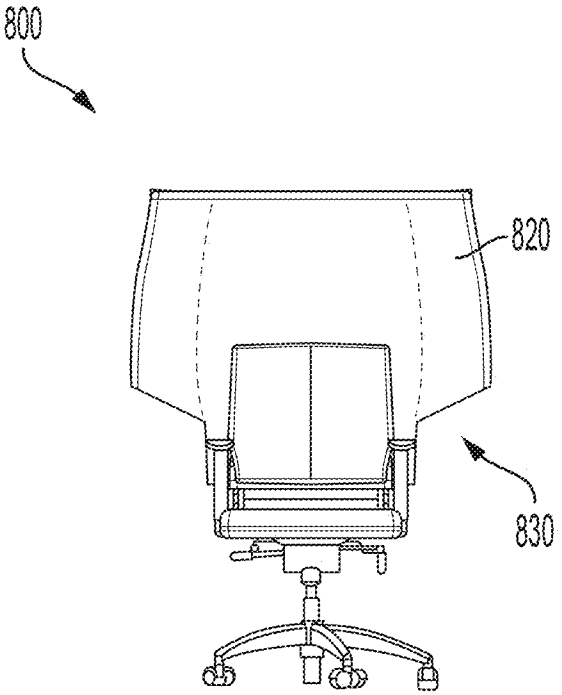

FIGS. 12A-12C are diagrams illustrating a chair assembly according to various exemplary embodiments. FIG. 12A is a front view of the chair assembly 800, FIG. 12B is a side view, and FIG. 12C is a perspective view of the chair assembly 800. In exemplary embodiments, the chair assembly 800 includes a chair 810 and a mounted attachment 820. In exemplary embodiments, the mounted attachment 820 is configured as so to three-dimensionally surround the chair 810 and provide all-around protection for a person sitting on the chair 810. In exemplary embodiments, the mounted attachment 820 includes anti-microbial, anti-bacterial and/or spandex material configured to inhibit or reduce the transmission of a contagious virus. In exemplary embodiments, the mounted attachment 820 may include, e.g., the wing 120 discussed above. In exemplary embodiments, the mounted attachment 820 extends circumferentially or semi-circumferentially around the chair 810 so as to surround a person sitting on the chair 810 from the back and the sides, leaving an opening in the front for the person to use the chair and meet with other people or work on a desk or computer. In exemplary embodiments, the mounted attachment 820 includes a recess 830 uncovering an area around armrests 840 of the chair 810.

FIGS. 13A-13F are diagrams illustrating a cover mounting assembly according to various exemplary embodiments. In FIGS. 13A1, 13A2 and 13B, the chair assembly 900 includes a support member 910 rigidly coupled to the chair 920 via one or more adjustable mounting brackets 930. In exemplary embodiments, the one or more mounting brackets 930 are configured to fix the support member 910 in space with respect to the chair 920. In exemplary embodiments, the support member 910 may provide support for a cover such as, e.g., the wings 120 discussed above. In exemplary embodiments, the adjustable mounting bracket 930 is configured to be adjustable as to fit any or most types of chairs. In exemplary embodiments, the adjustable mounting bracket 930 is functionally coupled to a tightening mechanism 935 such as, e.g., a ratchet mechanism, configured to tighten the adjustable mounting bracket 930 around the specific perimeter of the back of a chair 920, and secure the adjustable mounting bracket 930 to the chair 920. As a result, a secure chair assembly 900 may be formed, providing support for a cover such as, e.g., the wings 120 discussed above, based on many different types of chairs. The tightening mechanism is discussed in greater detail below.

Figure 13B:
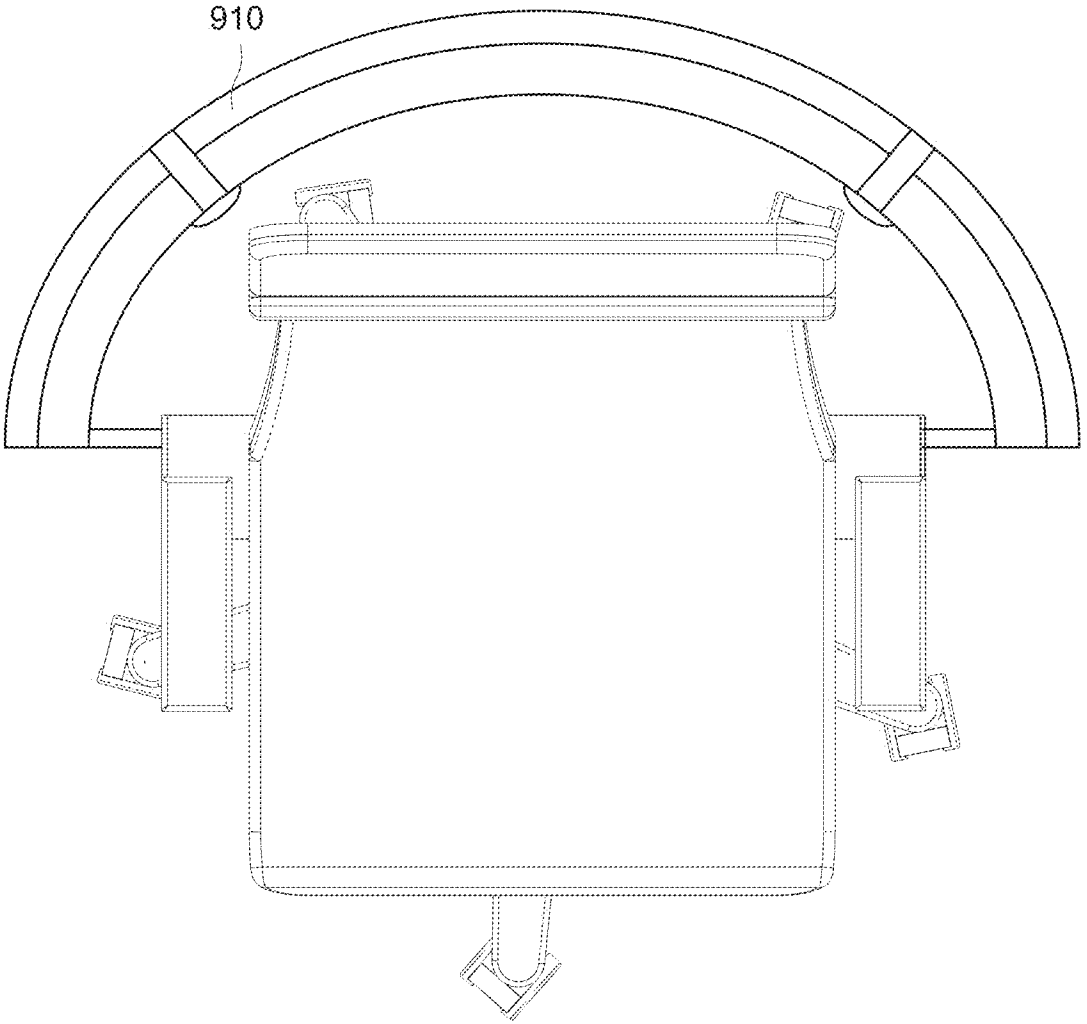
Figure 13C:
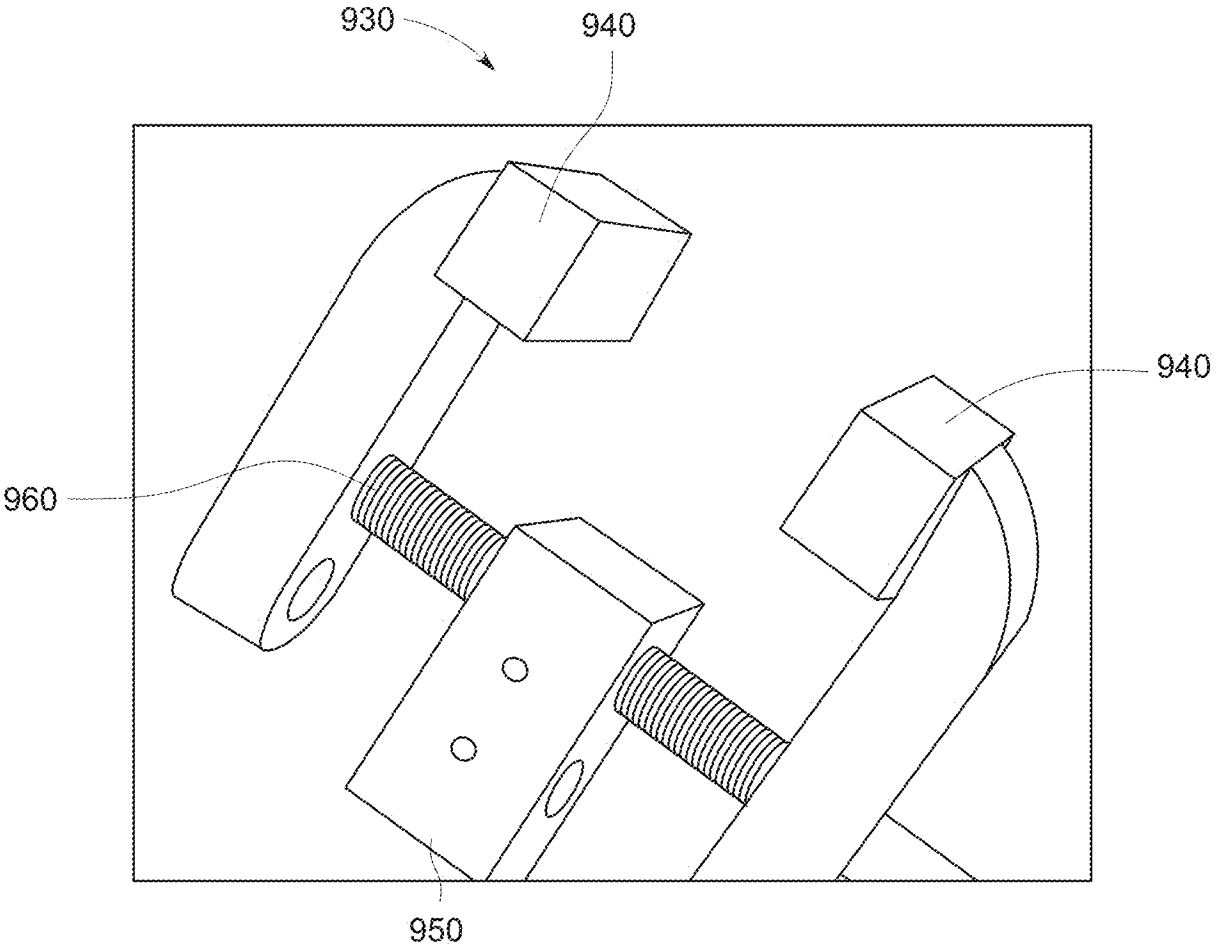
Figure 13D:
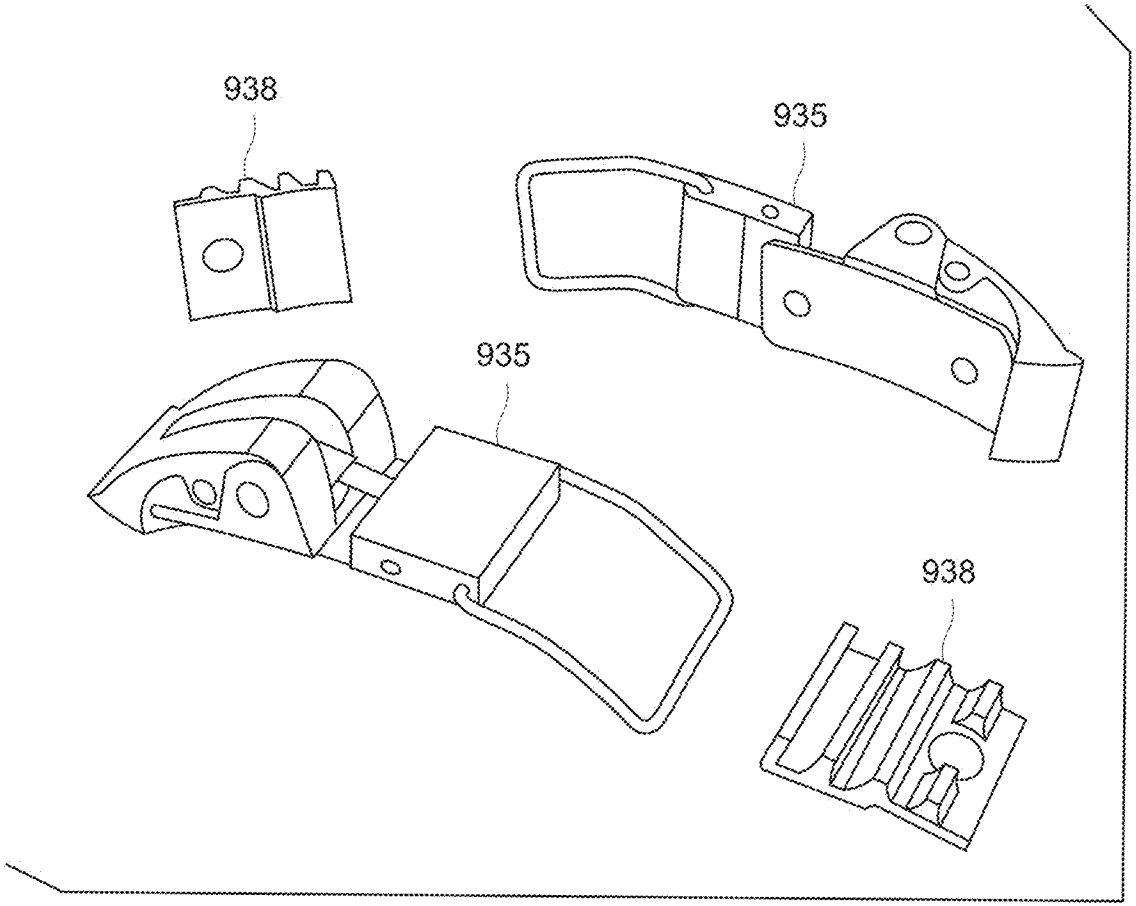

FIG. 13D is a photograph of an adjustable mounting brackets 930, according to various exemplary embodiments. In FIG. 13D, two opposing clamps 940 are provided on opposite sides of a threaded member 960 configured to adjust the distance between the clamps 940. In exemplary embodiments, the distance between the clamps 940 may be adjusted to fit the circumference, perimeter or shape of any or most currently available task chairs such as chair 920. In exemplary embodiments, the adjustable mounting brackets 930 further includes a center member 950 configured to rigidly secure the adjustable mounting brackets 930 to the back of the chair 920.

Figure 13E:
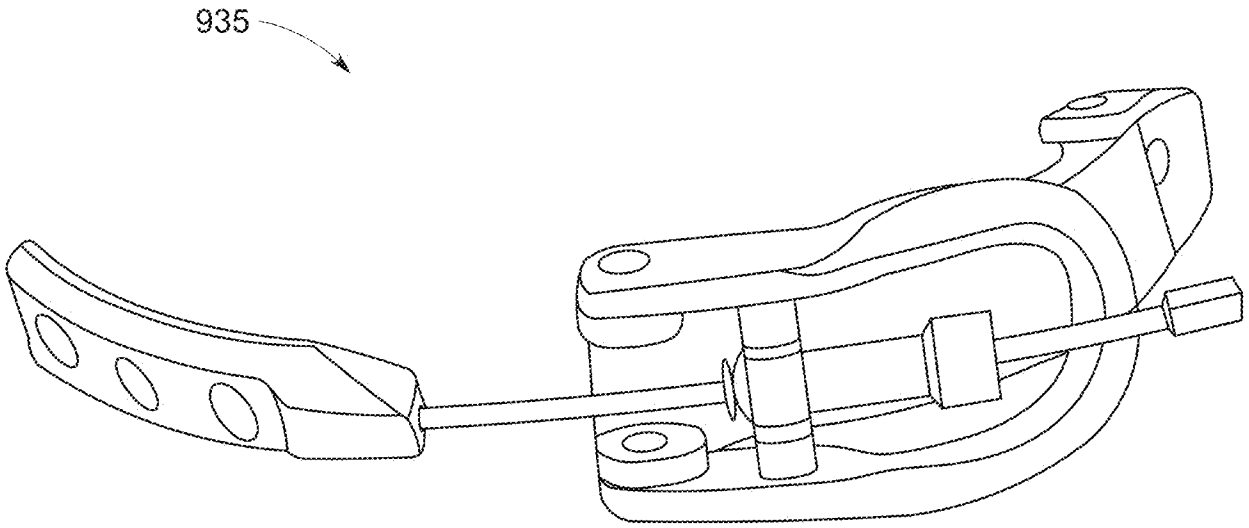
Figure 13F:
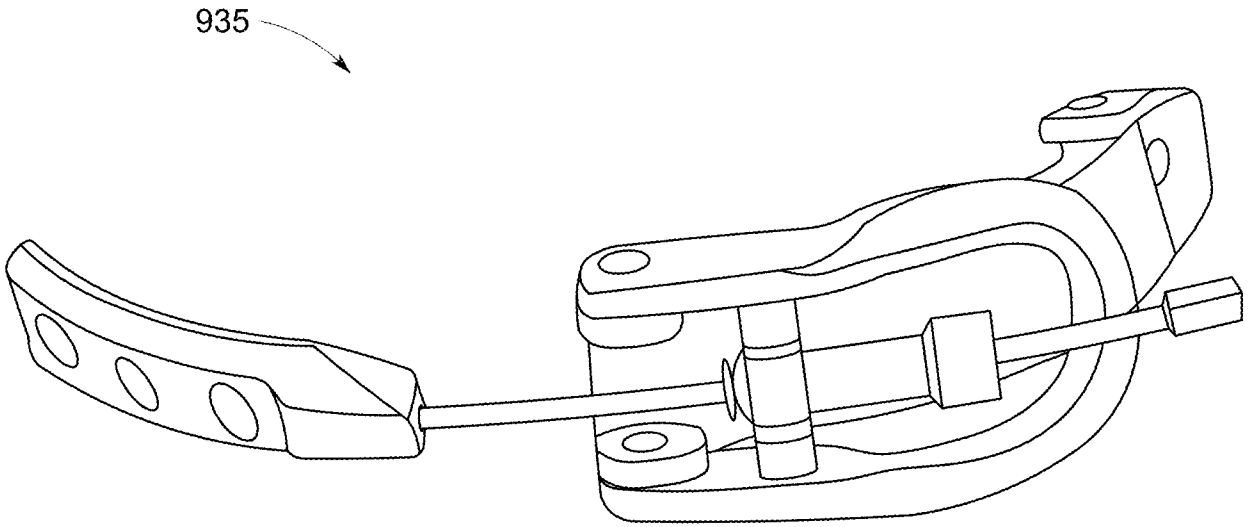

FIGS. 13E and 13F are photographs of a tightening mechanism 935, according to various exemplary embodiments. In FIGS. 13E and 13F, the tightening mechanism 935 is a ratchet mechanism. In exemplary embodiments, the ratchet mechanism 935 is configured to tighten an underlying structure coupled thereto via the coupling member 938. In exemplary embodiments, when the coupling member 938 is securely coupled to the support member 910 illustrated in FIG. 13B, the ratchet mechanism 935 can be used to tighten the support member 910 to the chair 920 to which the support member 910 is rigidly attached. In exemplary embodiments, the combination of the adjustable mounting brackets 930 and the tightening mechanism 935 provide an adjustable securing mechanism and support for a cover such as, e.g. the wings 120 discussed above, to be added to any or most currently available task chairs 920.

Figure 14A:
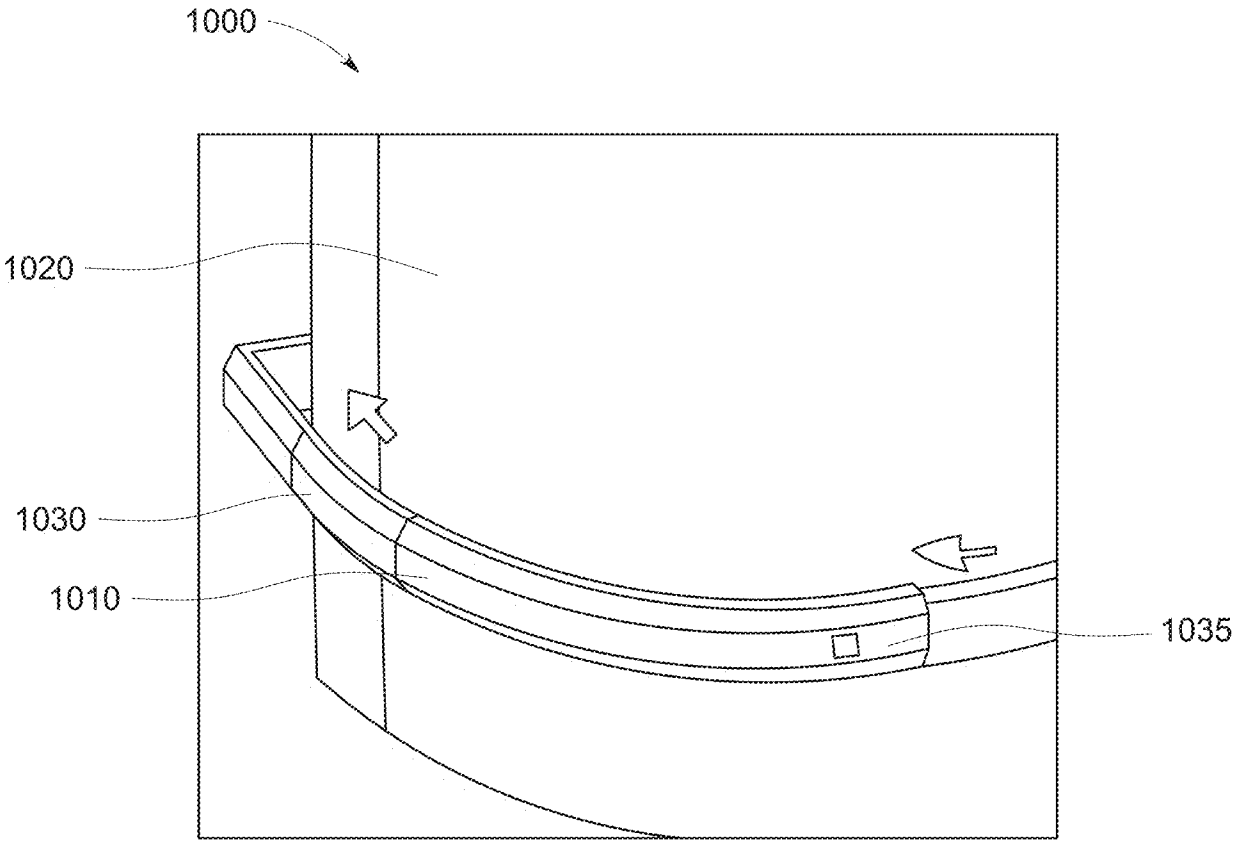
FIGS. 14A-14D are diagrams illustrating an adjustable mounting assembly according to various exemplary embodiments.

FIGS. 14A-14D are diagrams illustrating an adjustable mounting assembly according to various exemplary embodiments. In FIG. 14A, the chair assembly 1000 includes a support member 1010 rigidly coupled to the chair 1020 via one or more adjustable mounting brackets 1030. In exemplary embodiments, the one or more mounting brackets 1030 are configured to fix the support member 1010 in space with respect to the chair 1020. In exemplary embodiments, the support member 1010 may provide support for a cover such as, e.g., the wings 120 discussed above. In exemplary embodiments, the adjustable mounting bracket 1030 is configured to be adjustable as to fit any or most types of chairs. In exemplary embodiments, the adjustable mounting bracket 1030 is functionally coupled to a tightening mechanism 1035 such as, e.g., a ratchet mechanism, configured to tighten the adjustable mounting bracket 1030 around the specific perimeter of the back of a chair 1020, and secure the adjustable mounting bracket 1030 to the chair 1020. As a result, a secure chair assembly 1000 may be formed, providing support for a cover such as, e.g., the wings 120 discussed above, based on many different types of chairs. The tightening mechanism is discussed in greater detail below.

Figure 14B:
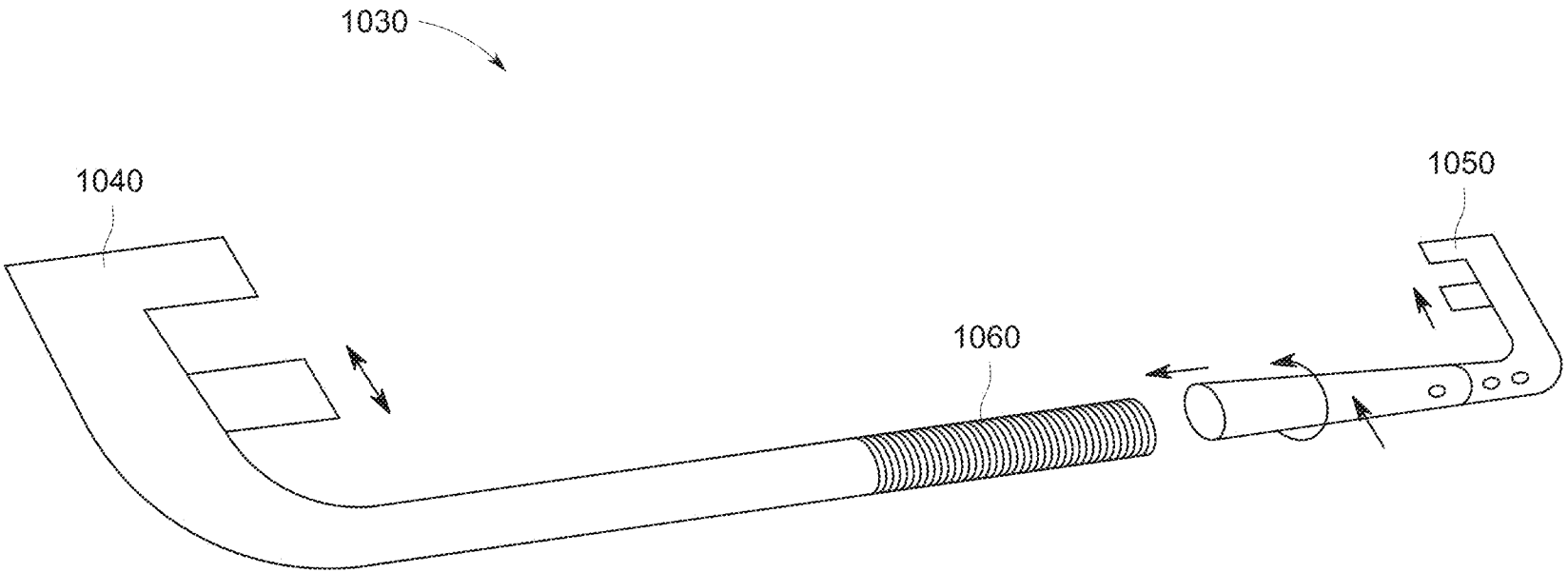
Figure 14D:
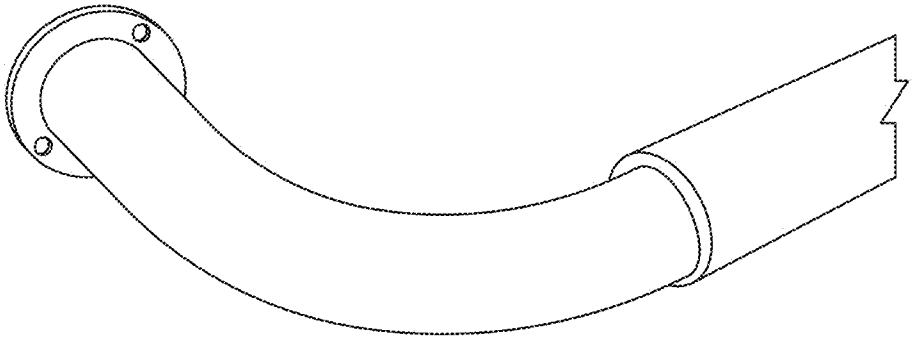
Figure 14C:
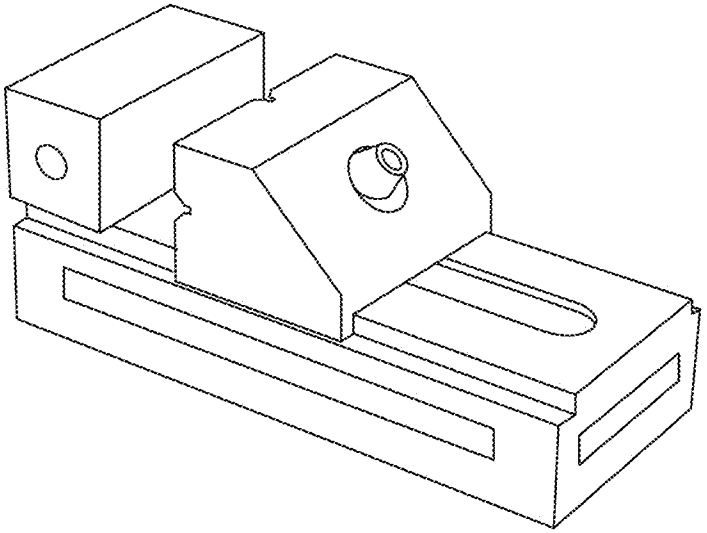

FIG. 14B illustrates an adjustable mounting bracket 1030, according to various exemplary embodiments. In exemplary embodiments, the adjustable mounting bracket 1030 includes a first portion 1040 and a second portion 1050 coupled together via an elongated center body 1060. In exemplary embodiments, the elongated center body 1060 includes. In exemplary embodiments, the first portion 1040 include a male threaded portion, and the second portion 1050 includes a female threaded portion. In exemplary embodiments, when the male threaded portion 1040 is rotatably coupled to the female threaded portion 1060 at the elongated center body, the adjustable mounting bracket 1030 can be adjusted to securely attach to the task chair 1020. FIG. 14C is a photograph of the first portion 1040, and FIG. 14D is a photograph of the elongated center body 1060, according to various exemplary embodiments.

Figure 15A:
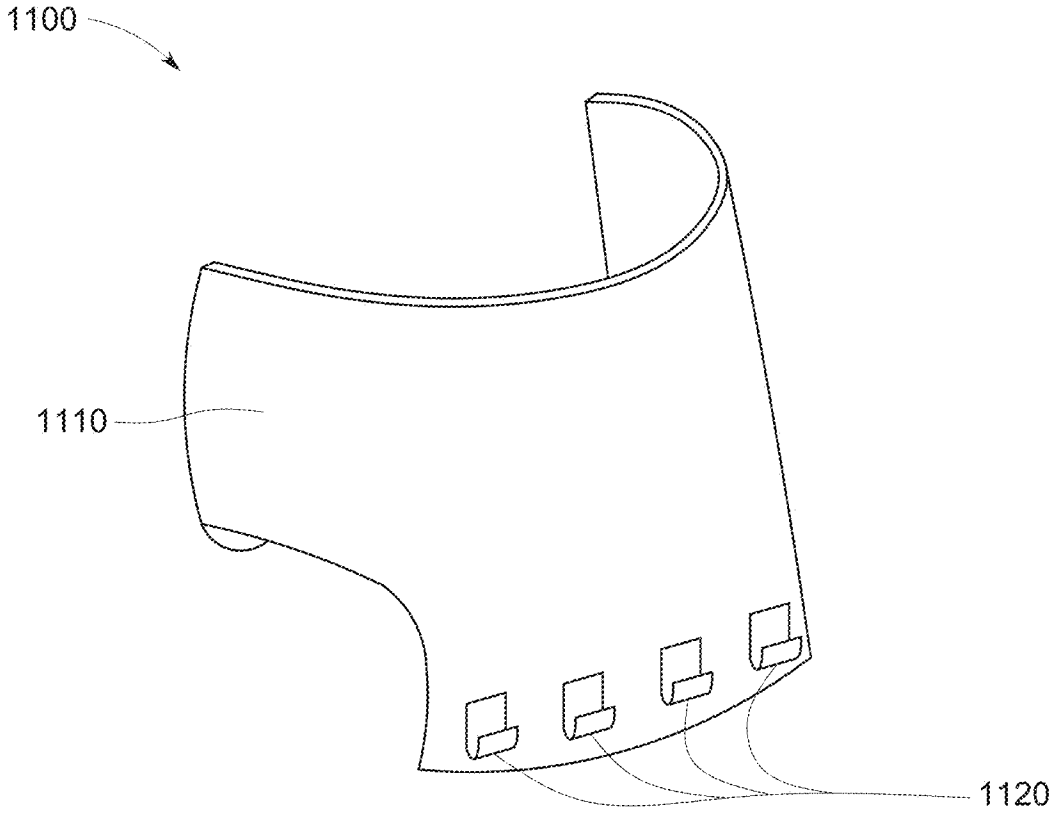
FIGS. 15A-15C are diagrams illustrating a cover mounting clip according to various exemplary embodiments.
Figure 15C:
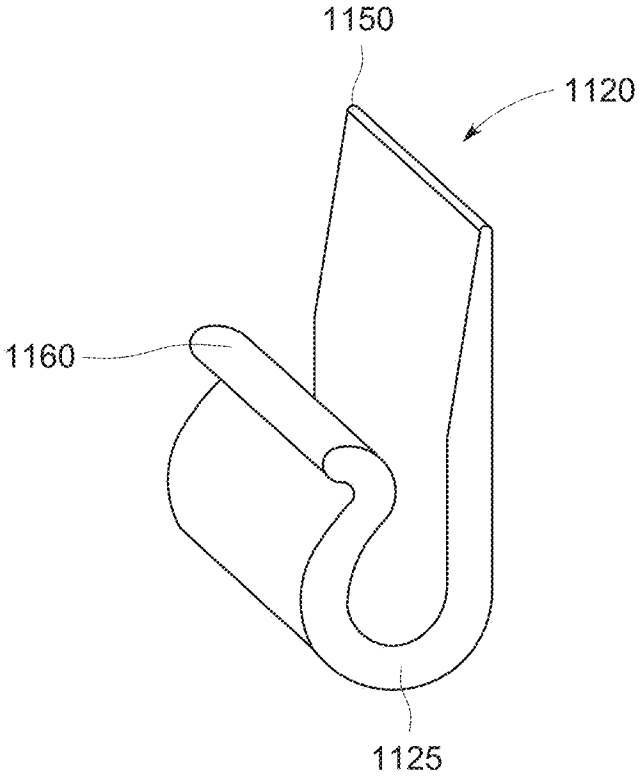
Figure 15B:
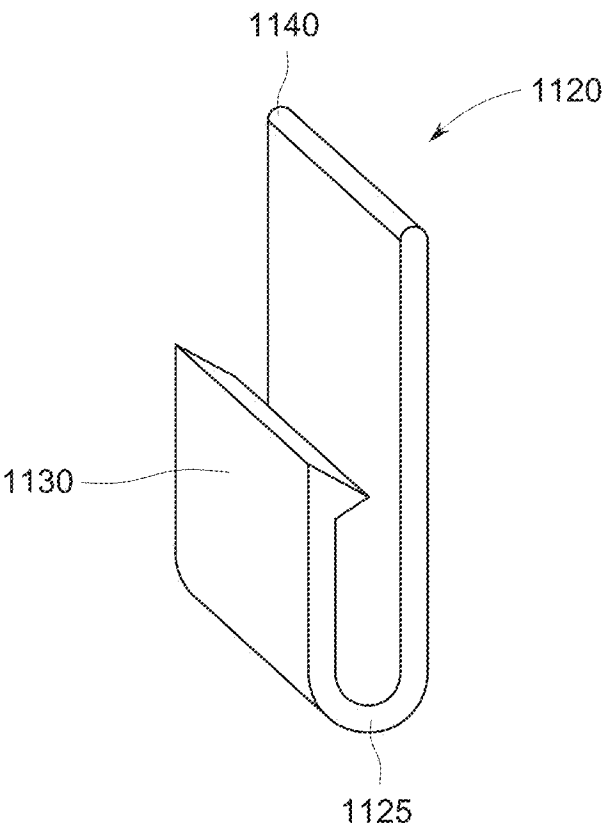

FIGS. 15A-15C are diagrams illustrating a cover mounting clip according to various exemplary embodiments. FIG. 15A illustrates, according to various exemplary embodiments, a chair assembly 1100. In exemplary embodiments, the chair assembly 1100 includes a plurality of mounting clips 1120 configured to attach to the back of a chair 1110. In exemplary embodiments, the mounting clips 1120 are configured to also provide support for a chair cover such as, for exemplary, the wing 120 discussed above. FIGS. 15B and 15C, according to various exemplary embodiments, illustrate a mounting clip 1120. In FIG. 15A, the mounting clip 1120 includes a U-shaped portion 1125 with a flat angled side 1130 and an opposite rounded side 1140. In exemplary embodiments, the flat angled side 1130 is shorter than the rounded side 1140. In operation, the U-shaped portion 1125 attaches to a portion of the back of a chair 1110, and the flat angled side 1130 provides a locking mechanism to secure the mounting clip 1120 to the back of the chair 1110. In FIG. 15B, the mounting clip 1120 includes a U-shaped portion 1125 with a curved rounded side 1160 and an opposite tapered side 1150. In exemplary embodiments, the curved rounded side 1160 is shorter than the tapered side 1150. In operation, the U-shaped portion 1125 attaches to a portion of the back of a chair 1110, and the curved rounded side 1160 provides a locking mechanism to secure the mounting clip 1120 to the back of the chair 1110.

A greater discussion on possible additions to a chair for both protection and comfort is provided below.

A Chair Cover with folding background Screen generally identified by reference numeral (10) will now be described with reference to FIG. 16 through 23.

Figure 16:
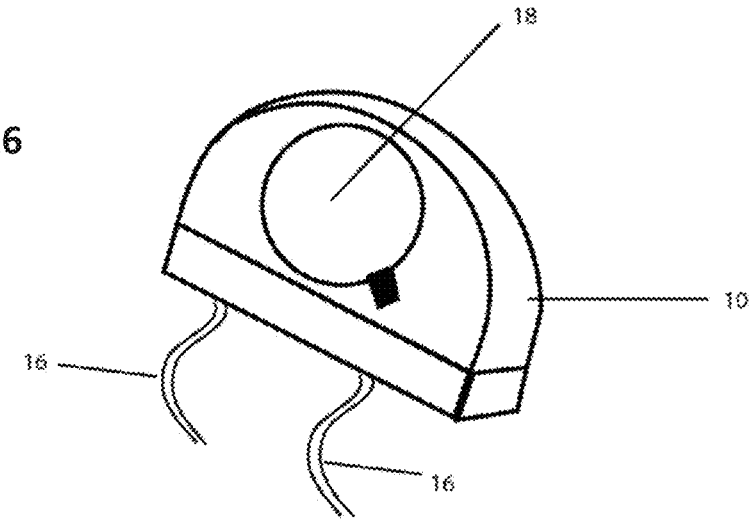
FIG. 16, is a rear perspective view of a chair's backrest folding screen device.

Structure and Relationship of Parts:

Referring to FIG. 16, there is illustrated a Chair's backrest folding screen device generally referenced by numeral (10) that supports on the back a foldable screen (18) made of a sheet of flexible material which deploys by memory wire (14) into a predetermined shape. Such Chair's backrest folding screen device (10) has at least one strap (16) that straps the chair cover to the chair (12).

Figure 17:
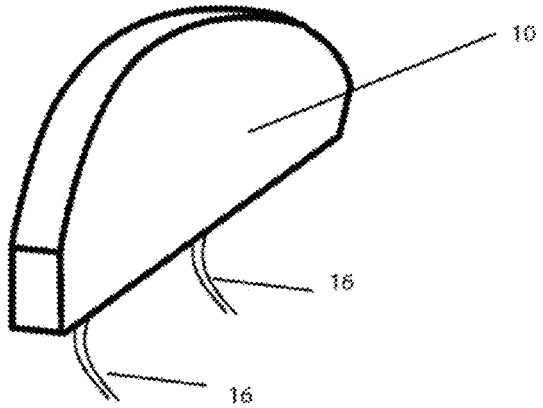
FIG. 17 is a front upper perspective view of a chair's backrest folding screen device.

Referring to FIG. 17, there is an illustrated front perspective of the Chair's backrest folding screen device.

Figure 19:
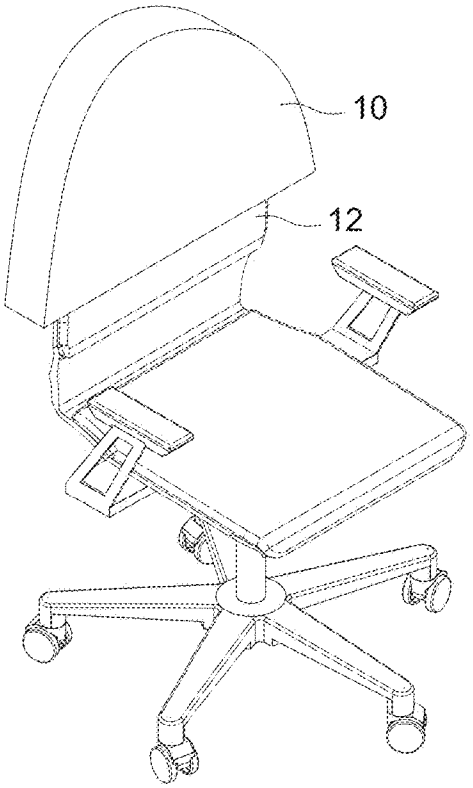
FIG. 19 is a front perspective view of a chair's backrest folding screen device installed in the chair's backrest.
Figure 18:
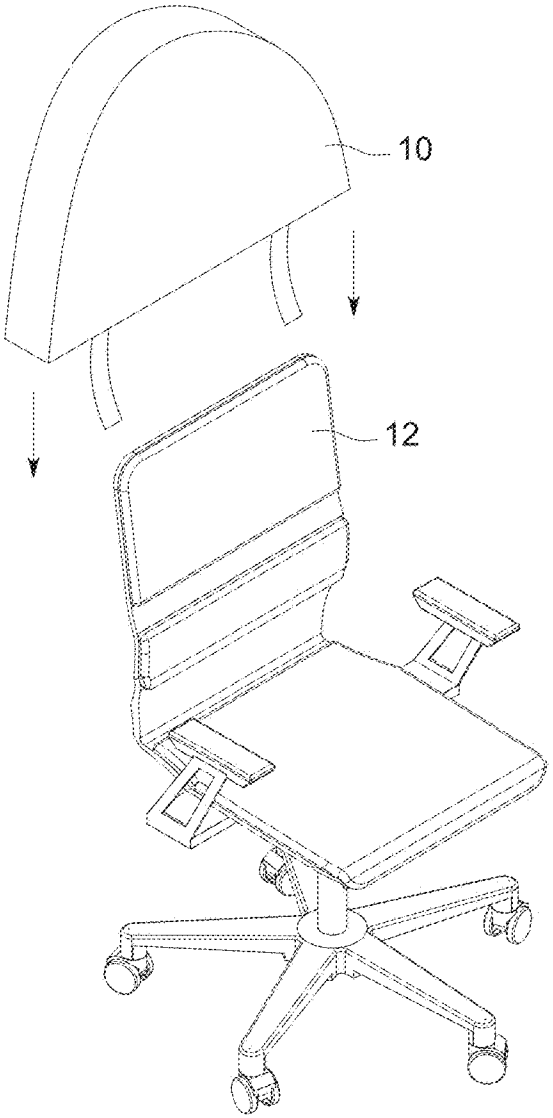
FIG. 18 is an exploded view of how a chair's backrest folding screen device attaches to an office chair.

Referring to FIGS. 18 and 19, the Chair's backrest folding screen device (10) attaches to the chair's backrest (12) and the straps (16) hold both of them together by strapping them to the chair (12).

Operation

Referring to FIGS. 18 and 19 there is an illustrated method on how to install the Chair's backrest folding screen device (10) to the chair's backrest (12) by strapping the straps (16) to the chair (12) structure and securing it tight.

Figure 20:
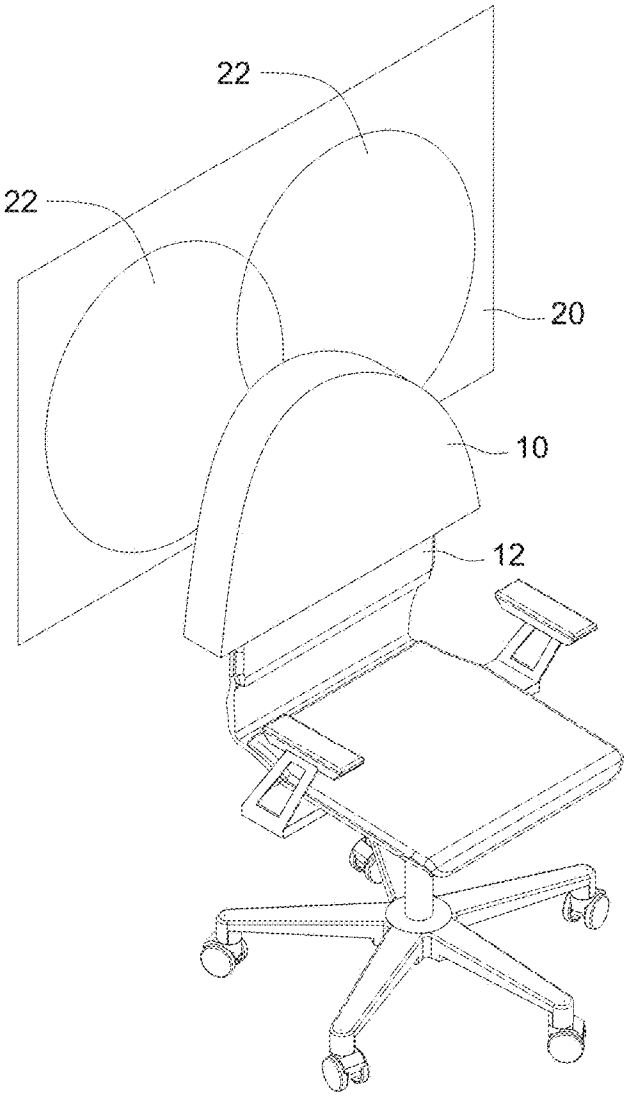
FIG. 20 is a front perspective view of a chair's backrest folding screen device with the folding background screen deployed showing the inside metal rims.

Referring to FIG. 20, chair cover with folding background screen (10) is fully deployed by the expanding force of the memory spring wires in oval shape (22) attached to the sheet of flexible material (20) for support and to act as a surface for a printed image or text.

Figure 7:
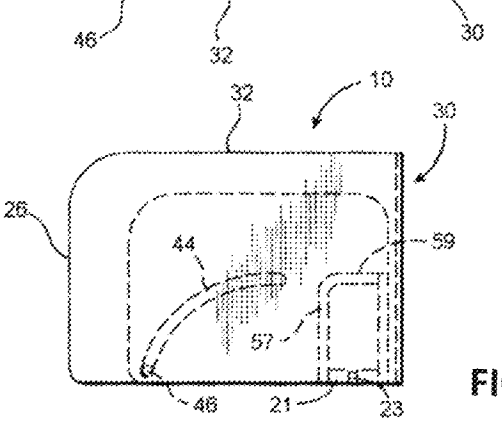
FIG. 7 is a side view of a privacy shroud of FIG. 3.
Figure 21:
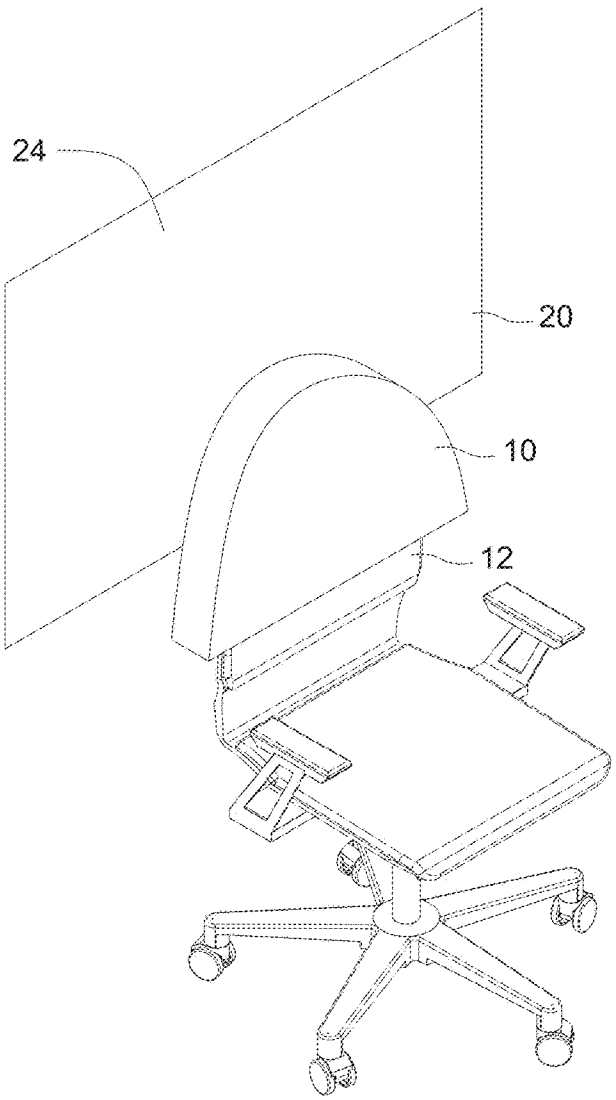
FIG. 21 is a front perspective view of the Chair's backrest folding screen device with the folding background screen deployed showing the outside screen image.
Figure 22:
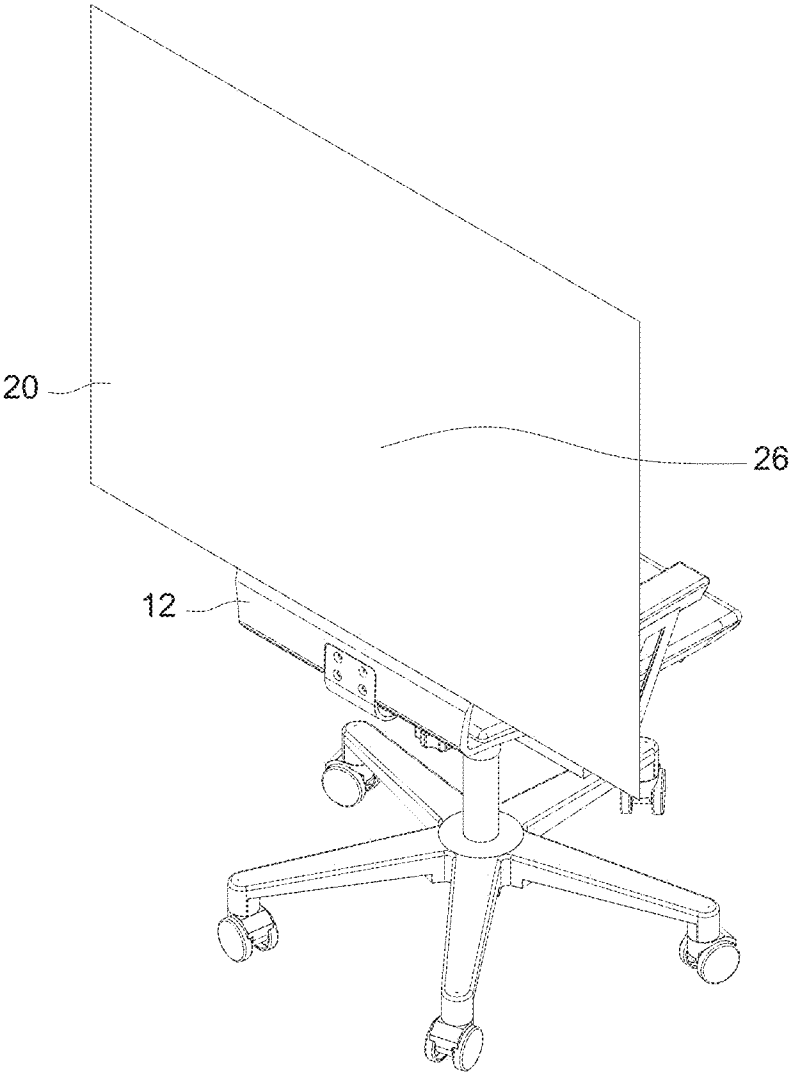
FIG. 22 is a back perspective view of the Chair's backrest folding screen device with the folding background screen deployed showing the back of the screen.

Referring to FIGS. 21 and 22, Chair's backrest folding screen device (10) fully deployed shows the front side (24) printed on the sheet of flexible material (20) and in FIG. 7 it shows the back side of the deployed background screen (26) printed on the back face of the sheet of flexible material (20) when the chair cover with folding background screen (10) is attached to the chair (12).

Figure 23:
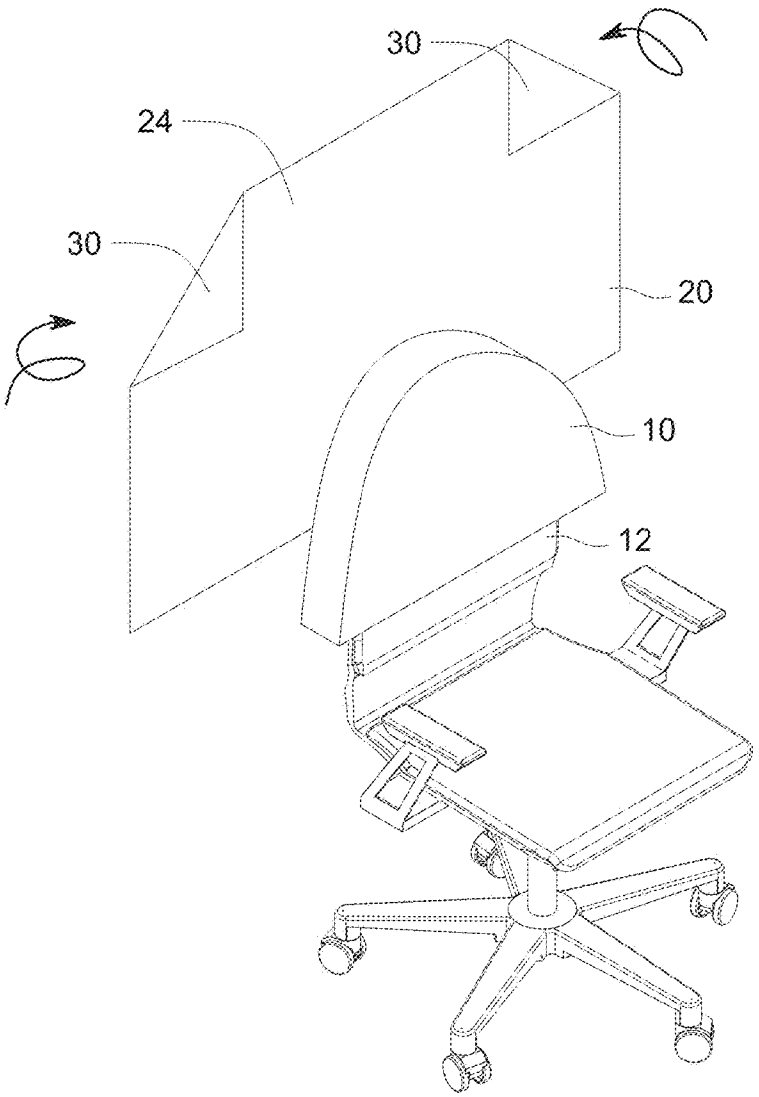
FIG. 23 is a front perspective view of the Chair's backrest folding screen device with the folding background screen folding.

Referring to FIG. 23, deployed background screen from the chair cover with folding screen (10) folds from the inside out from the corners position (30) until completely folded behind the chair cover (10) attached to the chair (12).

Figure 24:
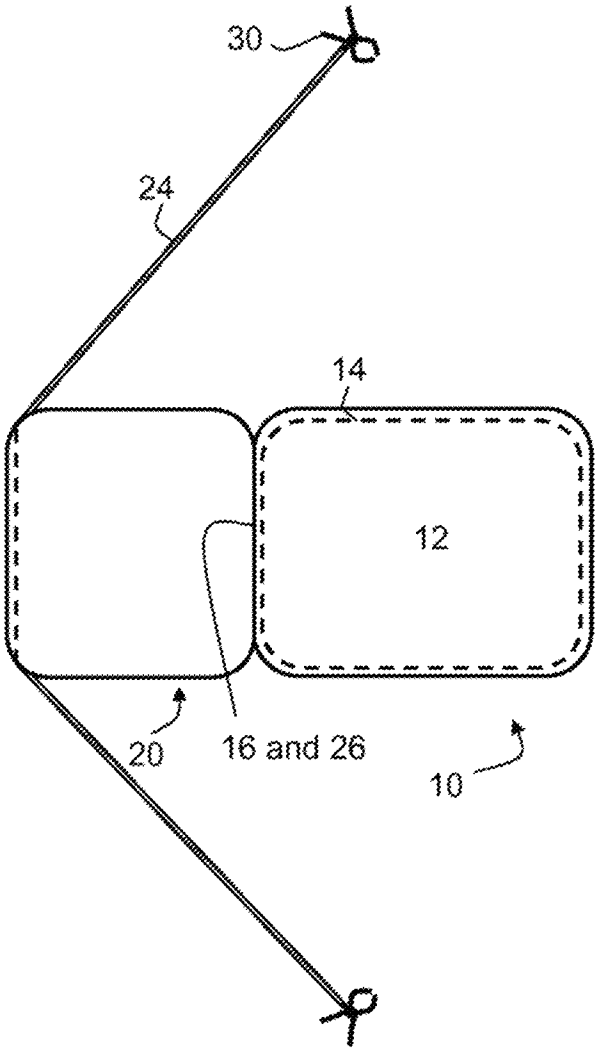
FIG. 24 is a top plan view of an exemplary embodiment of the two sheets of the chair canopy of the present invention laid out flat.

For ease of illustration and description, the drawings illustrate only the pertinent features of the present invention and do not show the remaining conventional features. FIG. 24 depicts an exemplary embodiment comprising the following elements: a) A first sheet 10 rectangular in shape with rounded corners comprising one or more layers of flexible material 12. b) A flexible thin strip, wire or rod (henceforth called rod) 14, configured as a closed loop and secured to the perimeter of the first sheet 10. c) A second sheet 20 also rectangular in shape with rounded corners comprising one or more layers of flexible material 22. d) A rod 24 configured as an open arc and secured to a portion of the perimeter of the second sheet 20. The edge 29 of the second sheet 20 along which rod 24 is secured shall be called "top edge" of second sheet 20. The two sheets are cut from a single piece of fabric or plastic and are shown with the frame secured to the sheets and with anchors configured to attach the canopy to a chair's backrest.

The flexible materials 12 and 22 can be conveniently made from one or more layers of a densely woven fabric made of organic, synthetic, or a mix of organic and synthetic material. In this embodiment, the sheets are made from a single piece of fabric. The bottom 26 of the second sheet 20 is attached to the top 16 of the first sheet 10. The flexible rods 14 and 24 can be made in part of spring steel, of flexible but tough plastic material, or of any other material capable of reversible deformation while generating appropriate forces in response to the deformation. Spring clips 30 secured to the ends of open arc rod 24 are used to attach the canopy to a chair.

If the sheets 10 and 20 comprise a single layer of material, the flexible rods 14 and 24 can be secured respectively to the sheets 10 and 20 by sewing hems along the perimeter of the sheets and inserting the rods 14 and 24 into the hems or by use of strips of flexible material surrounding the rods and sewn to the sheets. If the sheets 10 and 20 comprise two or more layers of material, the outer perimeters of the layers may be sewn together with the rods 14 and 24 contained between the layers. Other ways of securing rods 14 and 24 to sheets 10 and 20 will occur to those of ordinary skill in the art. Since rod 24 is open, rod 24 can be removed from the second sheet 20 when the canopy is not in its open configuration as long as the anchors do not get in the way or can be reversibly removed. The closed loop rod 14 maintains the first sheet 10 open and generally flat, suitable for installation against the backrest of a chair. This rod can have several different shapes. In an exemplary embodiment of FIG. 242, the shape of the closed loop is rectangular with rounded corners.

Figure 25A:
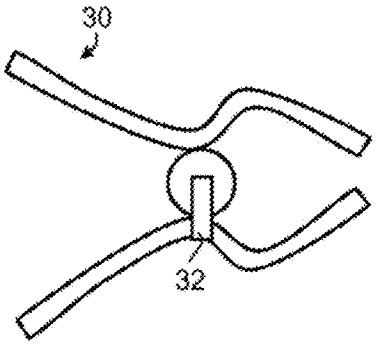
FIGS. 25A-25C provides views of an anchoring device including a receptacle shaped to fit onto the ends of the open arc rod.
Figure 25B:
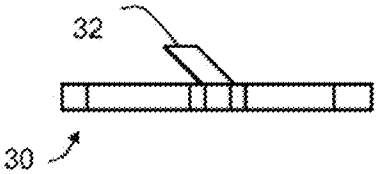
Figure 25C:
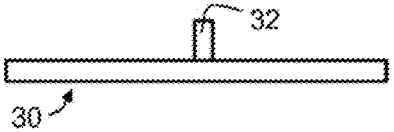

FIGS. 25A-25C show various views of a spring clip 30 suitable as the anchors to fasten the chair canopy to the backrest of a chair. FIG. 25A is the top view, FIG. 25B is the front view and FIG. 25C is the side view. Receptacle 32 attaches each spring clip to one end of the open arc rod. Those of ordinary skill in the art will recognize that other mechanisms can substitute for the spring clips such as, but not limited to, other types of clamps and clips, pins, screws, snaps, bolts, elastic bands, and cloth sleeves.

Figure 26:
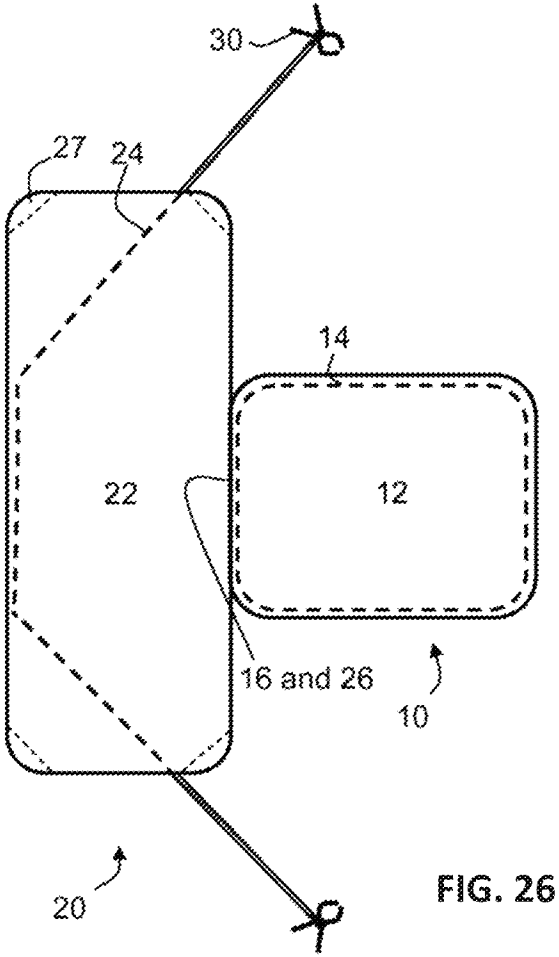
FIG. 26 is a top plan view of an exemplary embodiment of the two sheets of the chair canopy.

Referring to FIG. 26, in an alternative exemplary embodiment, the rectangular second sheet 20 is extended perpendicularly to the common axis shared with the first sheet 12. Each corner 27 of sheet 20 can be sewn with added weight to facilitate the extensions of sheet 20 to form side panels when the canopy is in its open configuration. This has the effect of forming an overhang to further block light and heat radiation. The open arc rod 24 can be secured to sheet 20 only at its top or at additional portions along their points of contact. The second sheet is in the shape of a rectangle such that side panels are created when the canopy is in its open configuration. The corners are weighted to help maintain their shape.

Figure 27:
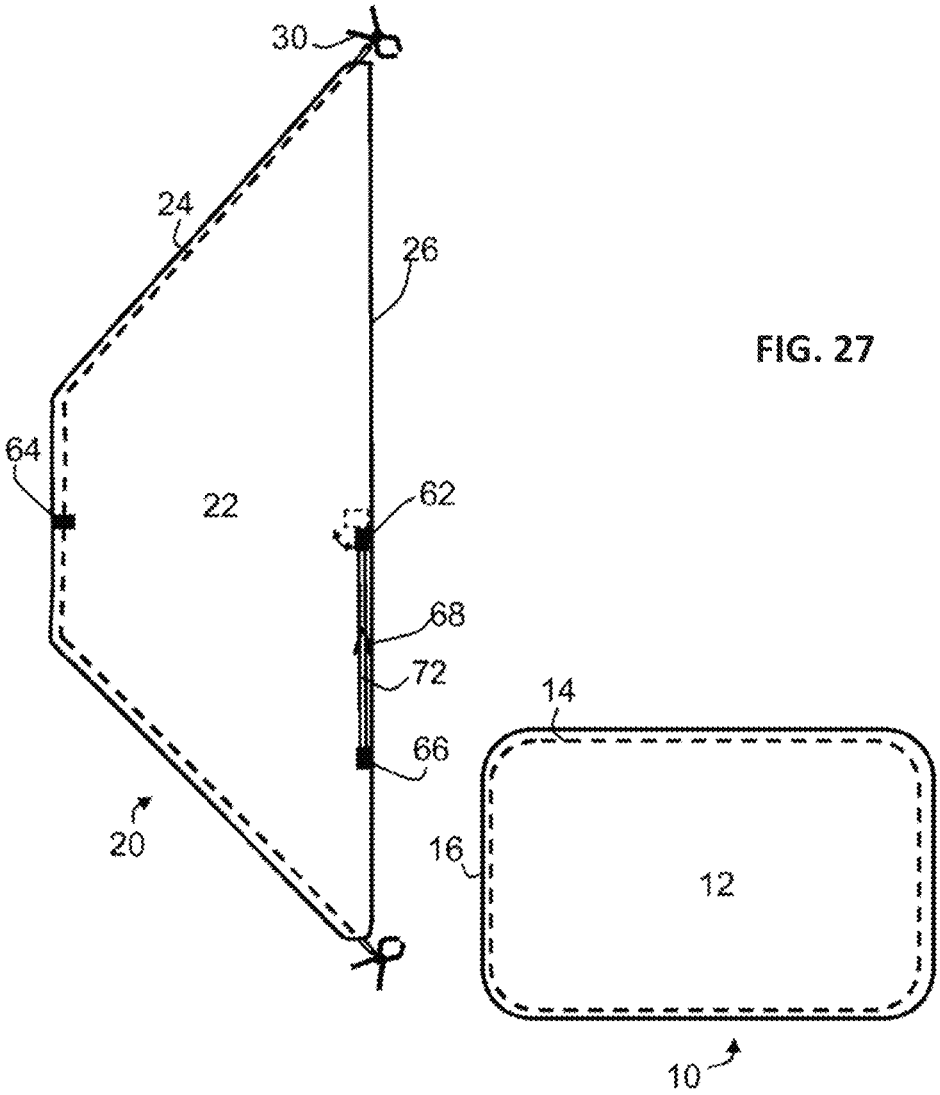
FIG. 27 is a top plan view of an exemplary embodiment of the two sheets of the chair canopy of the present invention laid out flat and before they are secured together.

FIG. 27 is an alternative exemplary embodiment in which the second sheet 20 is trapezoidal or the union of trapezoidal and rectangular sections, as shown, made of flexible material with open arc rod 24 secured to a portion of the perimeter of sheet 20. A nearly closed perimeter is formed by the open arc rod 24 and the bottom edge 26. When fully assembled, the attachment of the bottom edge 26 of the second sheet 20 to the first sheet 10 covers all of the top edge 16 of the first sheet 10 and portions of both side edges of the first sheet. 10. The attachment is oriented such that the middle of bottom edge 26 is joined to the middle of top edge 16. An advantage of the shape of the second sheet 20 in this embodiment is that it forms side panels in the open configuration of the canopy that are held in place by the open arc rod 24.

To prevent the second sheet 20 from sagging during use on a chair, a rib 72 is mounted on the second sheet 20. This rib 72 is permanently secured at one end to attachment 62 and is capable of rotating freely through an arc of 90° as indicated. The rib 72 is reversibly secured at its other end to either attachment 64 or 66. If needed during use on a chair, rib 72 secured to attachment 64 helps maintain the canopy in its open configuration. When rib 72 is secured to attachment 66, it is out of the way when the canopy is folded into its storage configuration. One or more guides 68 can keep rib 72 adjacent to closed loop rod 14 during storage. As shown, attachment 62 is adjacent to closed loop rod 14, but it could just as effectively be located adjacent to open arc rod 24, with concomitant switches to attachment 64 adjacent to closed loop rod 14 and attachment 66 adjacent to open arc rod 24.

The rib is shown constructed on the outside of the canopy, but it could just as usefully be constructed on the inside surface of the canopy. An advantage of being on the outside is that it might be more easily accessible to the user. An advantage of being on the inside is that it is somewhat constrained by the sheets when it is in its storage position. The rib can be made of a flexible strip, wire or rod, either be the same or different from the material used for the closed loop rod and/or open arc rod. Attachments 62, 64, and 66 can be cloth sleeves or made of any of a number of mechanisms, or combination thereof, familiar to those of ordinary skill in the art, such as, but not limited to, hooks, loops, snaps, and hook-and-loops. Guide 68 can also be a cloth sleeve or made of any of a number of mechanisms, or combinations thereof, familiar to those of ordinary skill in the art, such as, but not limited to, hooks, loops, snaps, and hook-and-loops.

An alternative exemplary embodiment for handling the rib is to construct it so that it is secured to attachments 62 and 64, both reversible attachments in this embodiment, when in use to maintain the canopy in its open configuration and then stored alongside the closed loop or open arc when not in use. The mechanism for storage could be a sleeve or snaps running adjacent to either closed loop rod 14 or open arc rod 24 or any other mechanism familiar to those of ordinary skill in the art. In this case, there is no need for attachment 66. When not in use to keep the canopy open, rib 72 is completely detached from attachments 62 and 64 and put in the mechanism for storage. The sheets are cut into separate pieces prior to securing them together. The second sheet comprises a union of generally trapezoidal and rectangular sections. Also shown is an optional rib to give added rigidity to the second sheet. The rib has different points of attachment, one for optional use in the canopies open configuration, and one for use during other times including storage.

Figure 28:
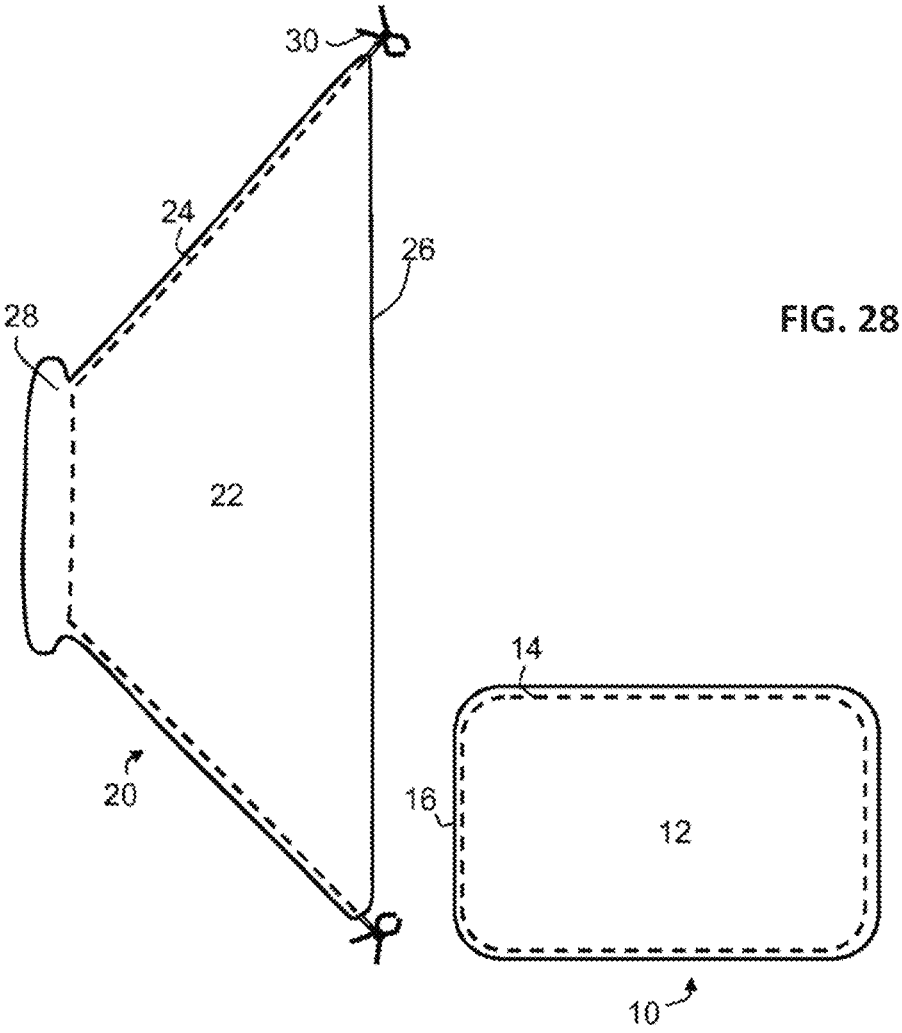
FIG. 28 is a top plan view of an exemplary embodiment of the two sheets of the chair canopy of the present invention.

Referring to FIG. 28, in an alternative exemplary embodiment, a portion 28 of the second sheet 20 lies outside of the perimeter formed by the open arc rod 24 to form a fringe. This has the effect of forming a front panel when the canopy is in its open configuration to further block light and heat radiation. Likewise, additional sheet material can be added along the other edges of the second sheet 20 to form larger side panels. In an embodiment, portions of the second sheet extend beyond points at which the open arc rod is secured to it in order to form an additional panel for the open canopy to provide more shading.

Figure 29:
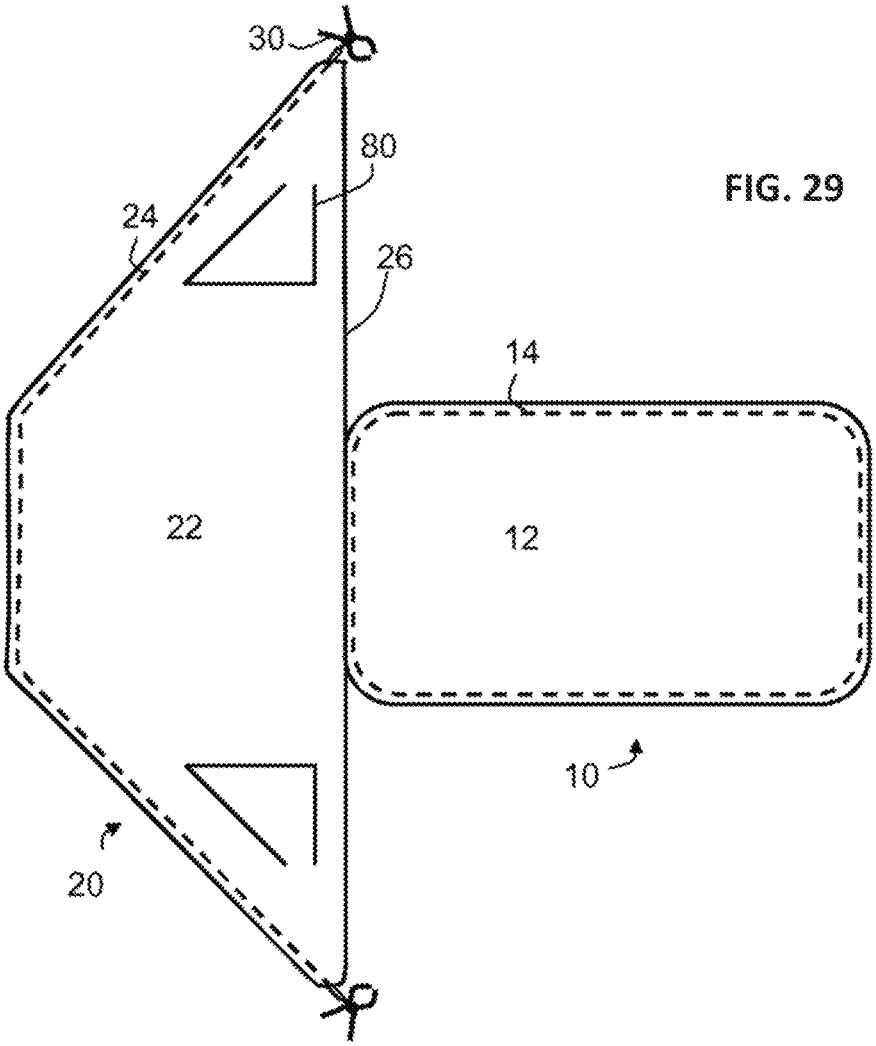
FIG. 29 is a top plan view of an exemplary embodiment of the two sheets of the chair canopy of the present invention.

In another exemplary embodiment, FIG. 29 depicts the first sheet 10 and second sheet 20 cut from the same piece of fabric so that they share portions of a top and bottom edge, again respectively, prior to making any later attachments between the sheets. Optional window flaps 80 are cut into the second sheet 20. The window flaps can be held closed with hook-and-loop fasteners or a similar device such as a snap or other closure mechanism known to those of ordinary skill in the art. Ventilation and user visibility are increased when the flaps are open. The two sheets are cut from, and into, a single piece and are shown with the frame already secured but before the two sheets are fully sewn together. Also shown are optional window flaps for increased ventilation and user viewing.

Figure 30:
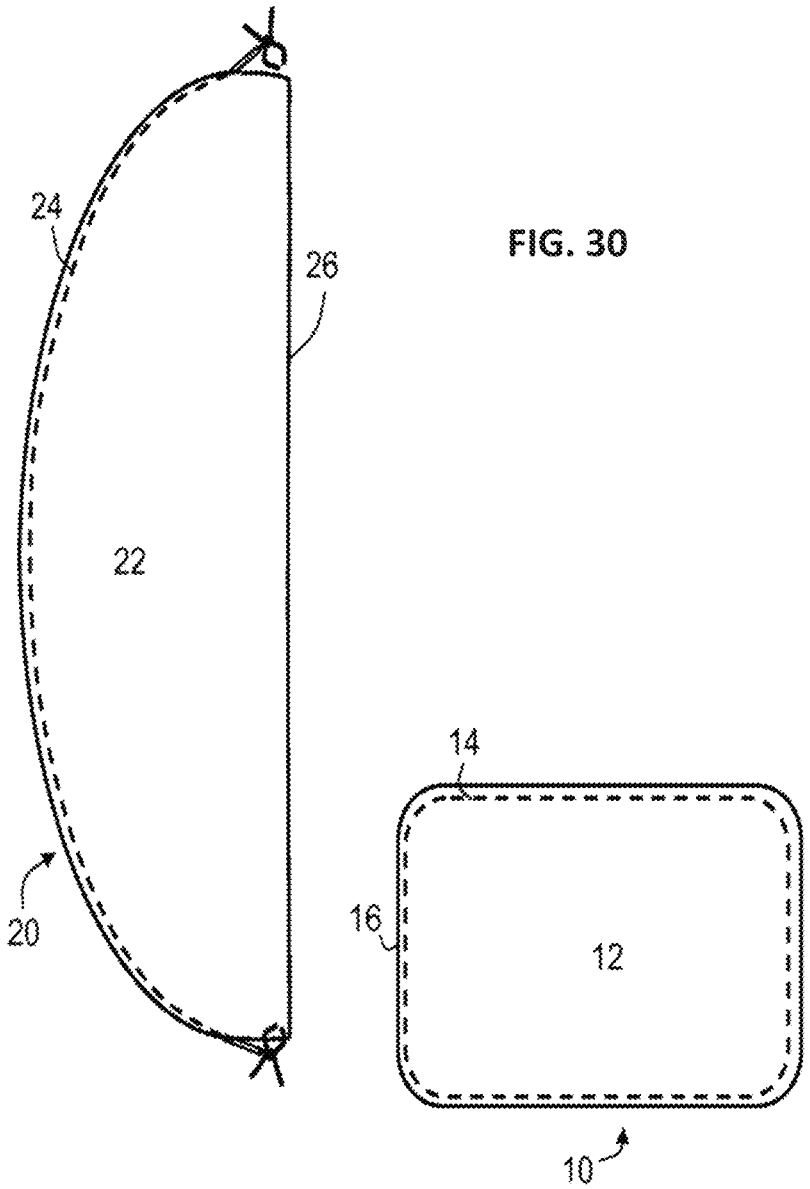
FIG. 30 is a top plan view of an exemplary embodiment of the two sheets of the chair canopy of the present invention in which the second sheet comprises a semi-elliptical section in union with a rectangular section.

FIG. 30 shows another exemplary embodiment of the present invention in which the second sheet 20 is shaped as the union of generally semi-elliptical and rectangular sections of flexible material with the open arc rod 24 secured to a portion of the perimeter of the second sheet 20.

A greater discussion of fasteners used in chair assemblies in provided below.

In exemplary embodiments, it may be beneficial to allow coworkers in an open office environment to collaborate and work together, while also allowing them to speak on a telephone as though in a private office without the surrounding noise of fellow coworkers in the open office environment. For exemplary, coworkers in an open office environment need to be able to communicate with each other, while also being able to talk on the phone without the person on the other end of the line hearing the chatter in the background. The individual also needs to be able to concentrate while adjacent coworkers are on the phone. Similar to the open office environment, it can also be difficult to have visual and/or acoustic privacy in other open environments, such as in schools, restaurants, cafeterias, airport terminals, testing centers, libraries, home offices, etc.

Accordingly, exemplary embodiments include an apparatus or devices including visual and/or acoustic privacy features that can provide a user with at least some privacy and isolation from others in the open environment. For exemplary, exemplary embodiments are disclosed that include visual and/or acoustic privacy features for furniture (e.g., office chair, desk, table, cubicle, etc.). For exemplary, the visual and/or acoustic privacy features (e.g., pads, screens, pads, blinders, panels, walls, wings, flaps, other means for providing visual and/or acoustic privacy features, etc.) may be releasably attachable or mountable to, fixedly attached to, integral to, supported by, etc. a support surface of a piece of furniture.

The visual and/or acoustic privacy features may be movable relative to the user and/or furniture between at least a first configuration and a second configuration. In the first configuration, the visual and/or acoustic privacy features are not being used to provide visual or acoustic privacy (e.g., not disposed adjacent, along, or around the user's head, etc.) such that they do not inhibit the user from interacting with others. For exemplary, the visual and/or acoustic privacy features may be stowed and/or out of the way such that they are spaced apart from (e.g., not generally over, adjacent, or in front of, etc.) the user's ears, eyes, and/or mouth, etc. But in the second configuration, the visual and/or acoustic privacy features are deployed for use (e.g., disposed generally over, adjacent, and/or in front of the user's ears, eyes, and/or mouth, etc.) so as to provide the user with at least some visual and/or acoustic privacy and isolation from others, such as by acoustically dampening of incoming and/or outgoing sound and/or by providing visual blinders. Accordingly, the first configuration may also be referred to as a stowed, non-use, non-operational, or interaction configuration, while the second configuration may also be referred to as a deployed, in-use, operational, or privacy configuration.

In some embodiments, the visual and/or acoustic privacy features may be movable relative to the user and/or furniture into a third configuration. For exemplary, the visual and/or acoustic privacy features may be moved into a third configuration in which they may be positioned generally upright and above a computer monitor to thereby offer a hood effect to help control light (e.g., block or shield incoming light, etc.). The position of the visual and/or acoustic privacy features may provide visual cues to co-workers. For exemplary, the visual and/or acoustic privacy features may be positioned in a certain configuration (e.g., above the user's head, etc.) to indicate that the user is open for conversation. As another exemplary, the visual and/or acoustic privacy features may be positioned adjacent or around the user's head to indicate that the user is tasking and does not wish to be disturbed.

Figure 31:
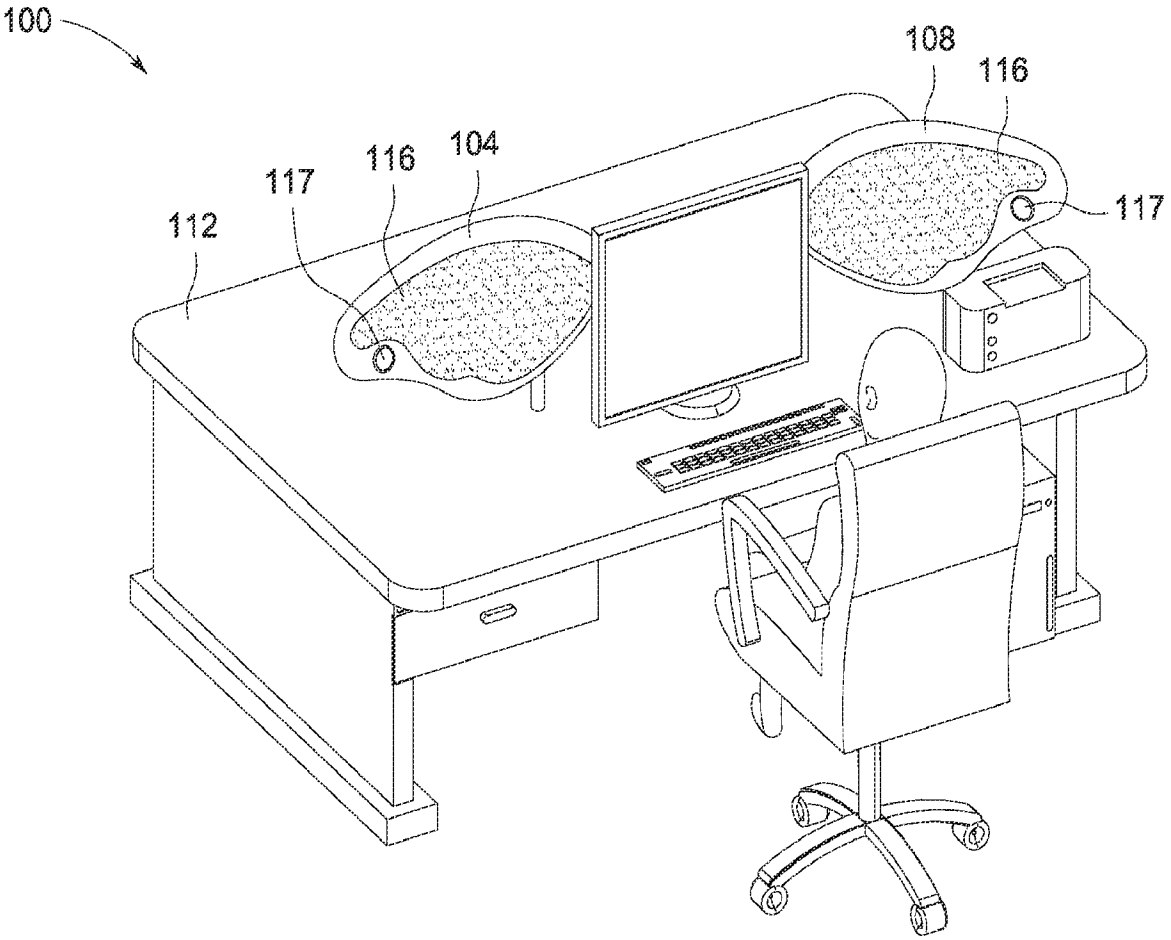
FIG. 31 is a perspective views showing visual and/or acoustic privacy features mounted to and/or supported by a desk according to an exemplary embodiment, where the visual and/or acoustic privacy features.

With reference now to the figures, FIGS. 31 through 39 illustrate an exemplary embodiment 100 including first and second (or left and right) visual and/or acoustic privacy features 104, 108 embodying one or more aspects of the present disclosure. As shown in FIG. 31, the visual and/or acoustic privacy features 104, 108 are mounted to and/or supported by a desk 112 in this exemplary. Alternatively, the visual and/or acoustic privacy features 104, 108 may be mounted to and/or supported by other support surfaces, e.g., chairs, tabletops, etc.

Figure 32:
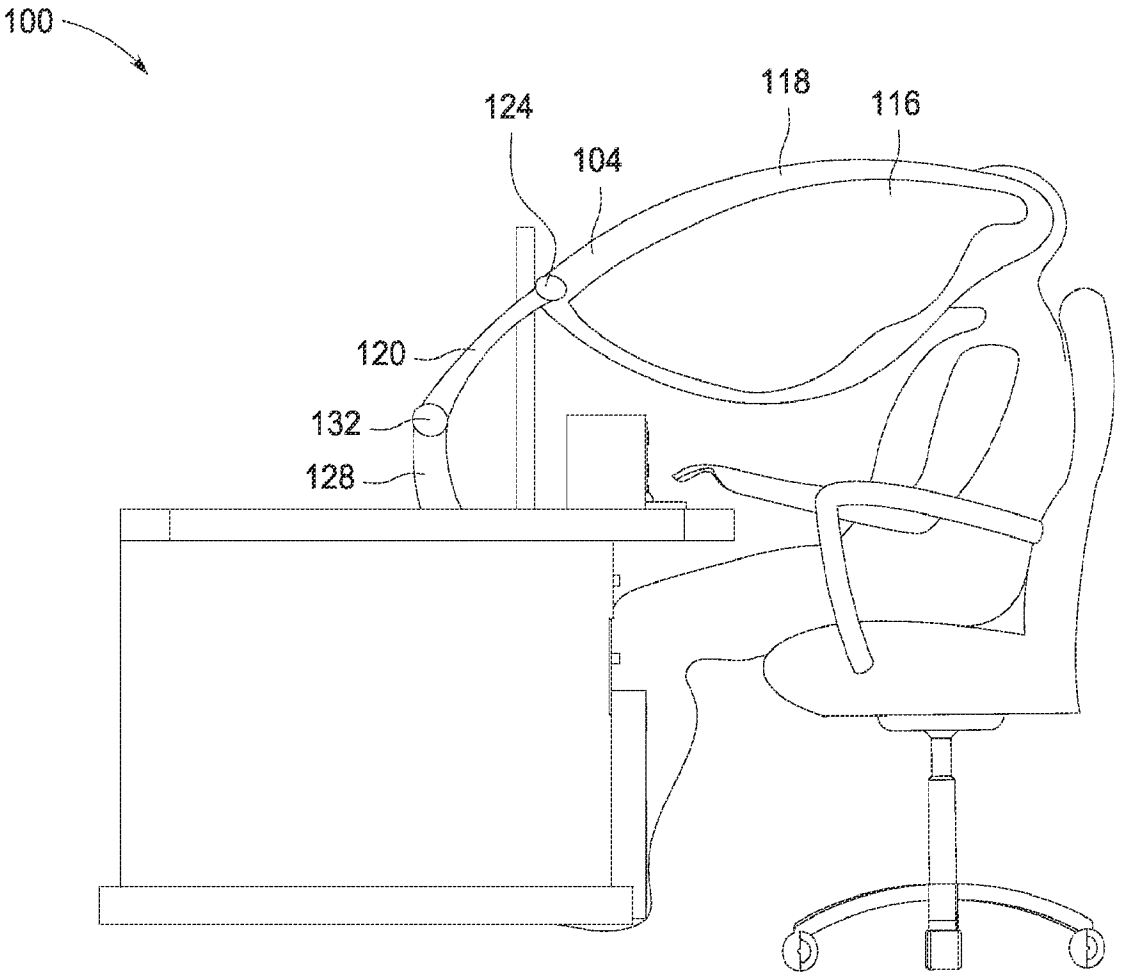
FIG. 32 is a side view of the visual and/or acoustic privacy features in which the visual and/or acoustic privacy features are adjacent the user's ears and along opposite sides of the user's head so as provide the user with at least some visual and/or acoustic privacy and isolation from others according to an exemplary embodiment.

In this exemplary embodiment, the visual and/or acoustic privacy features 104, 108 are usable and reconfigurable between a plurality of configurations, including a first configuration (FIG. 31) and a second configuration (FIG. 32). In the first configuration shown in FIG. 31, the visual and/or acoustic privacy features 104, 108 are not disposed adjacent the user's ears or along opposite side of the user's head, such that the user may easily and readily interact with others. Also in the first configuration, the visual and/or acoustic privacy features 104, 108 may provide the user with visual privacy by creating a wall or blinder in front of the desk, which, in turn, may help the user to better concentrate and not be distracted by on goings in front of the desk.

In the second configuration shown in FIG. 32, the visual and/or acoustic privacy features 104, 108 are deployed for use (e.g., disposed generally over, adjacent, and/or in front of the user's ears, eyes, and/or mouth, etc.) so as to provide the user with at least some visual and/or acoustic privacy and isolation from others. As shown in FIG. 32, the visual and/or acoustic privacy features 104, 108 are disposed generally around the user's head so as to cover the user's ears and eyes from the side. In the second configuration shown in FIG. 32, the visual and/or acoustic privacy features 104, 108 acoustically dampen incoming and/or outgoing sound and provide visual blinders. Accordingly, the features 104, 108 may thus provide means for acoustically dampening incoming and/or outgoing sound and providing visual blinders.

Additionally, or alternatively, any one of various configurations of the visual and/or acoustic privacy features 104, 108 may be used to provide visual cues to co-workers. For exemplary, the visual and/or acoustic privacy features 104, 108 may be positioned in a certain configuration to visually indicate that the user is open for conversation. As another exemplary, the visual and/or acoustic privacy features 104, 108 in the second configuration (FIG. 32) may visually indicate that the user is tasking and does not wish to be disturbed.

Figure 34:
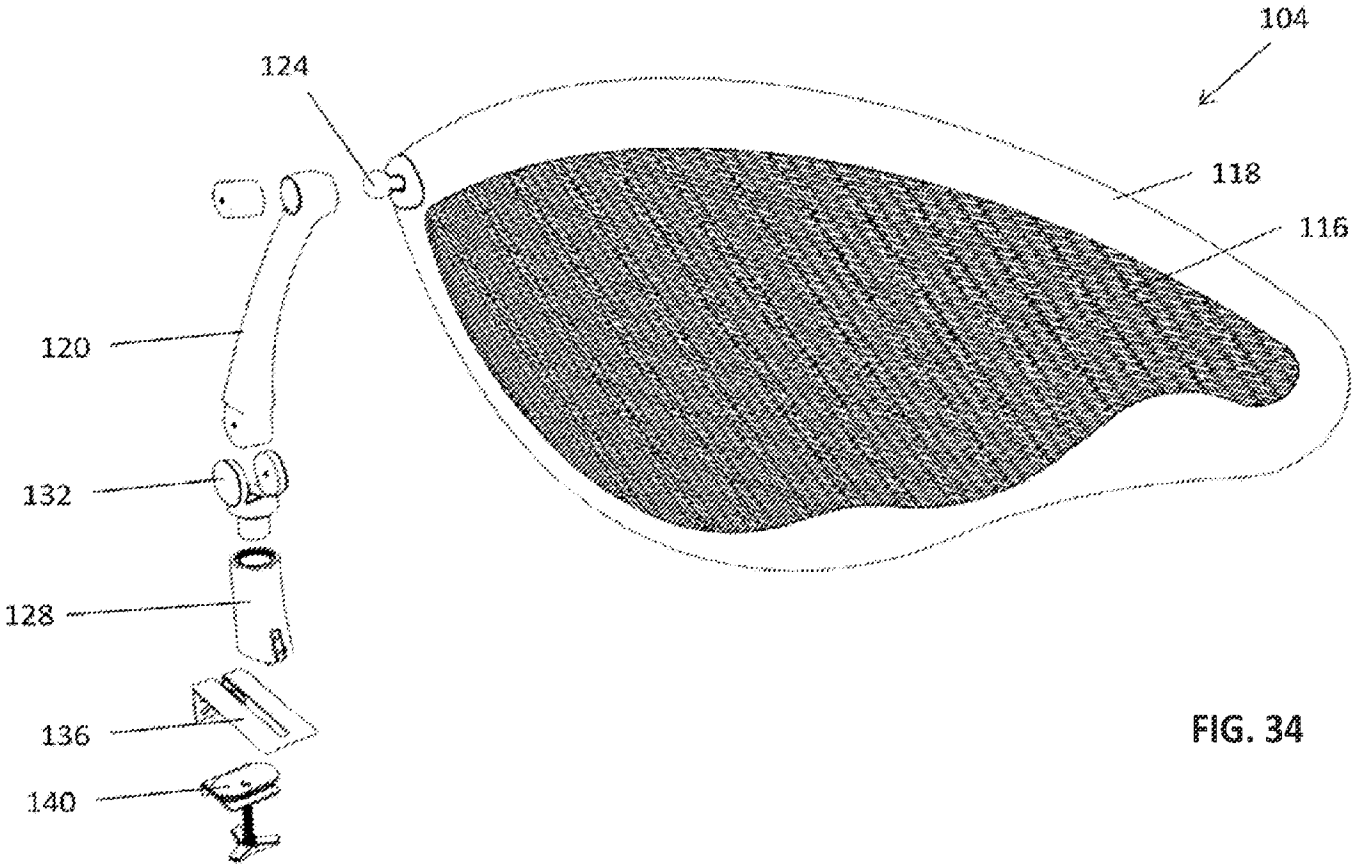
FIG. 34 is an exploded perspective view of one of the visual and/or acoustic privacy features.
Figure 35:
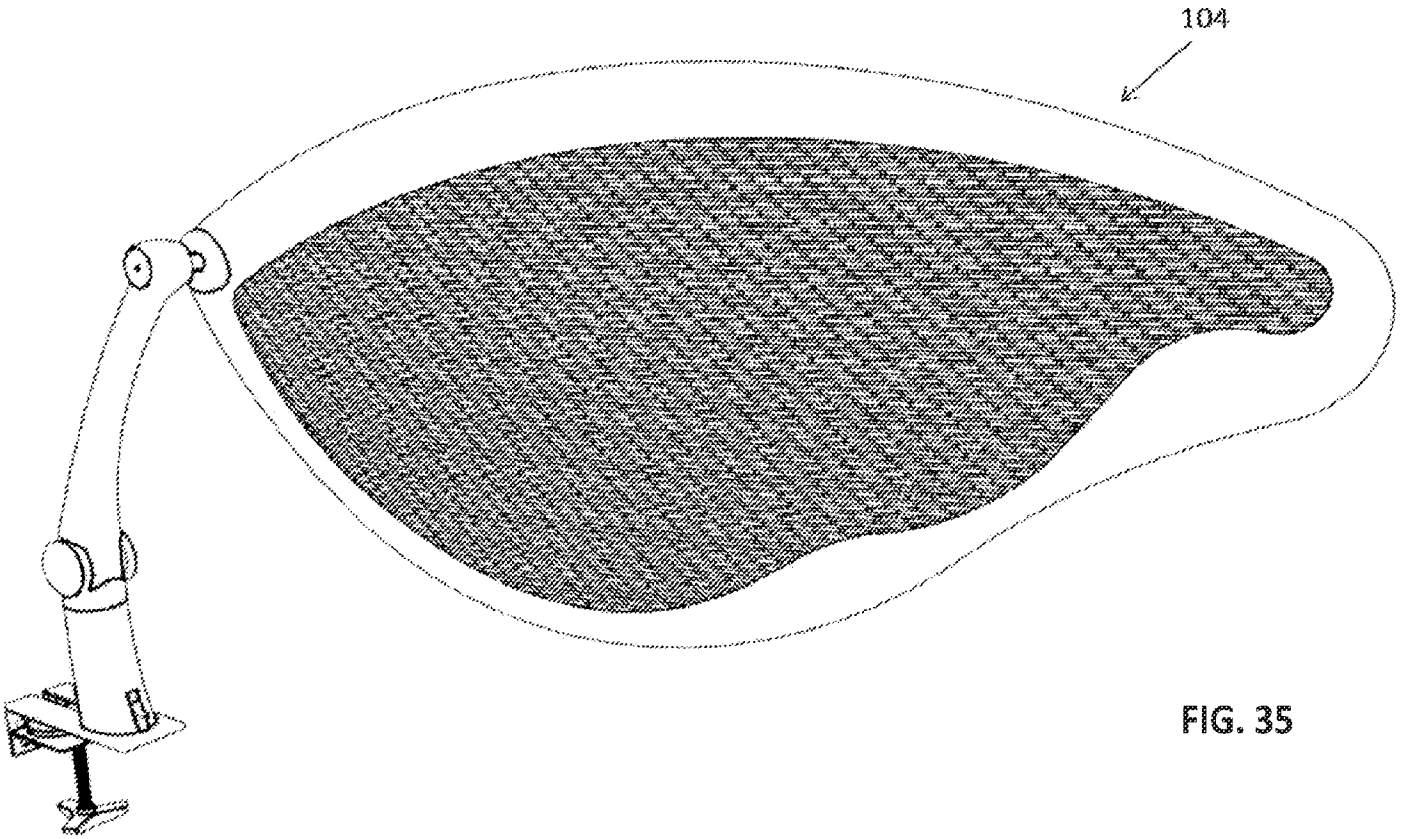
FIGS. 35 and 36 are perspective views of the visual and/or acoustic privacy feature shown in FIG. 34 after the components have been assembled together.
Figure 36:
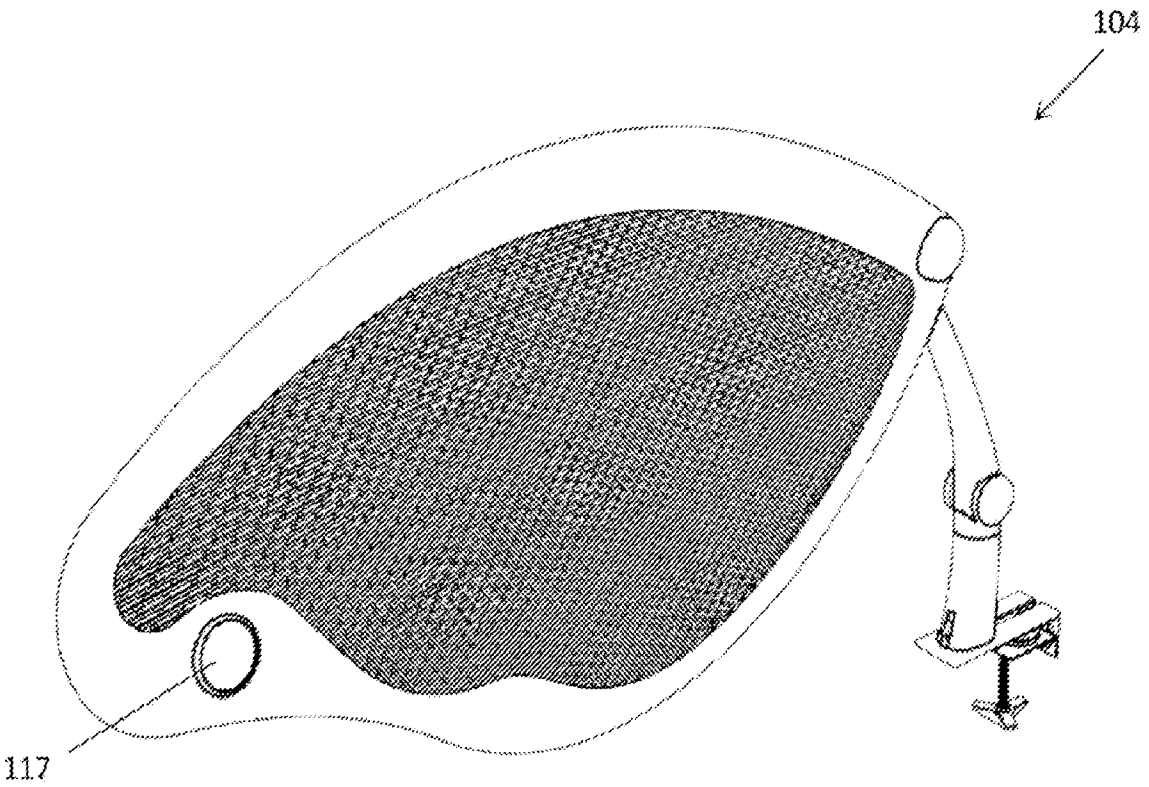
Figure 37:
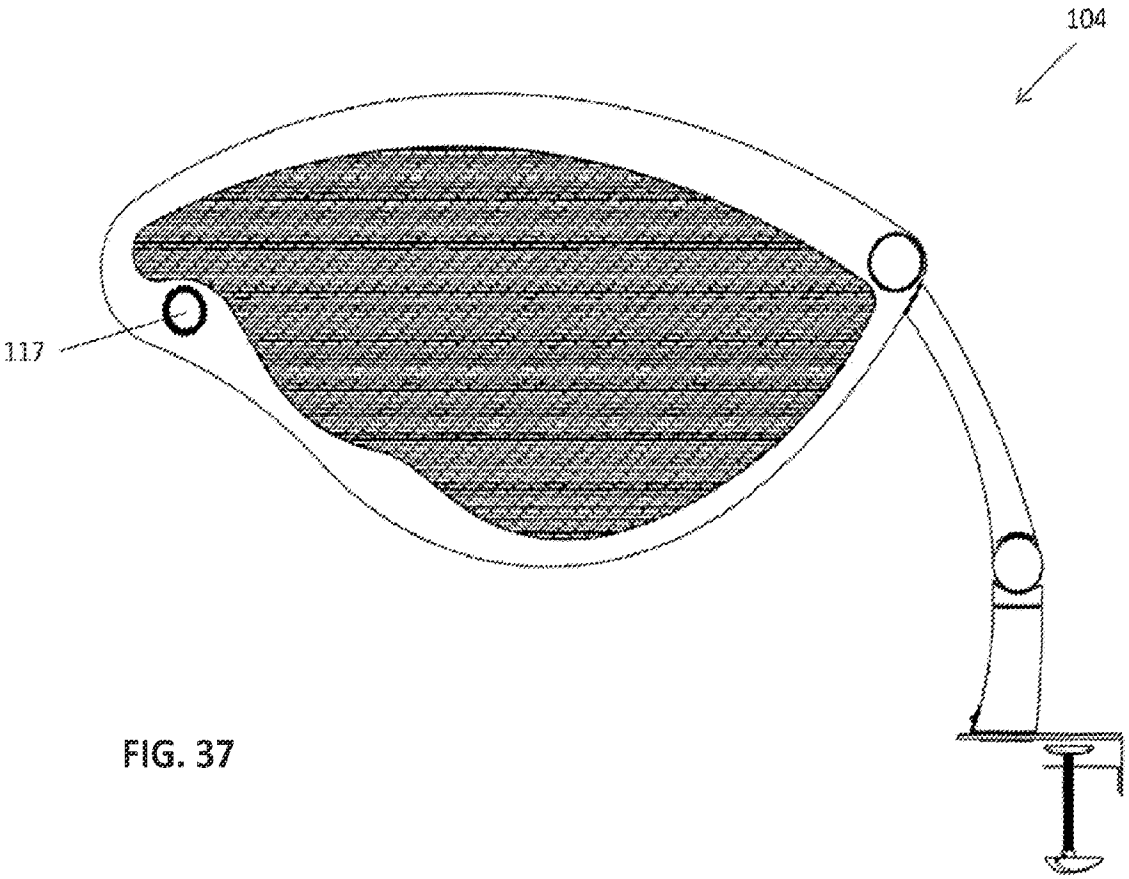
FIGS. 37 and 38 are side views of the visual and/or acoustic privacy feature shown in FIG. 35.
Figure 38:
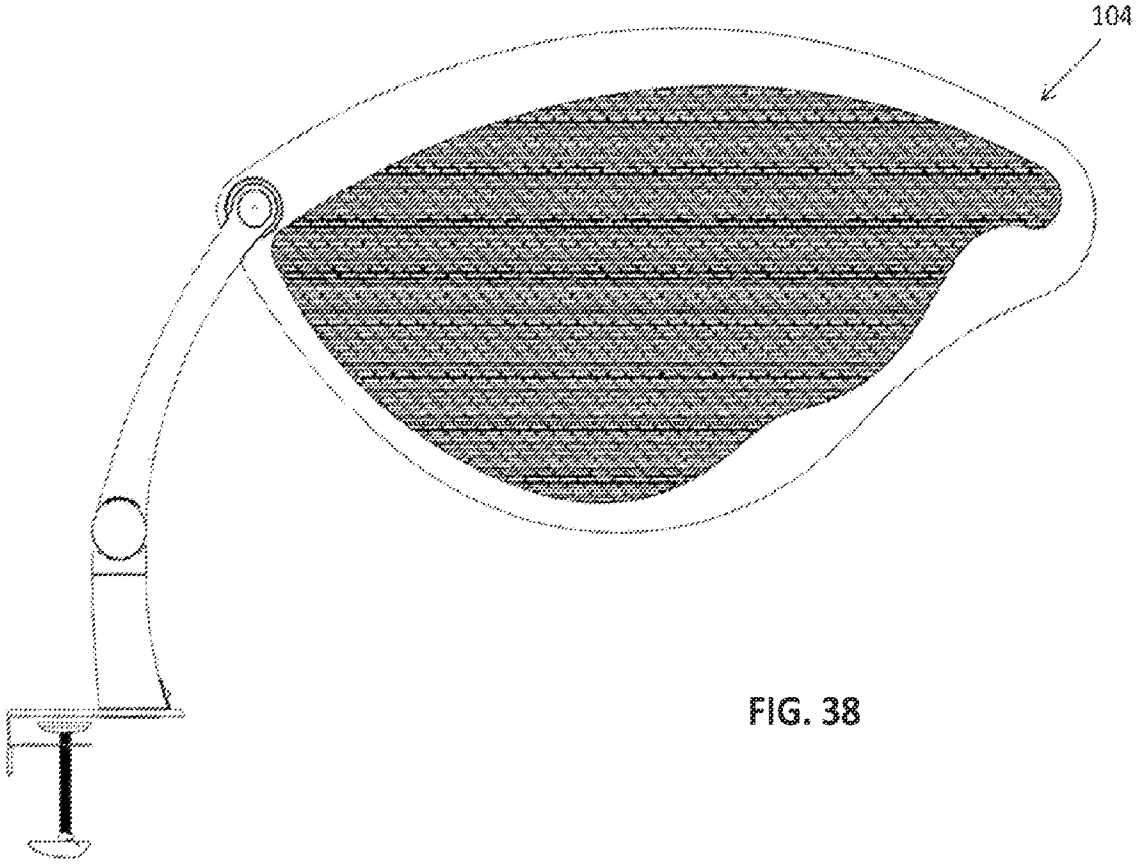
Figure 39:
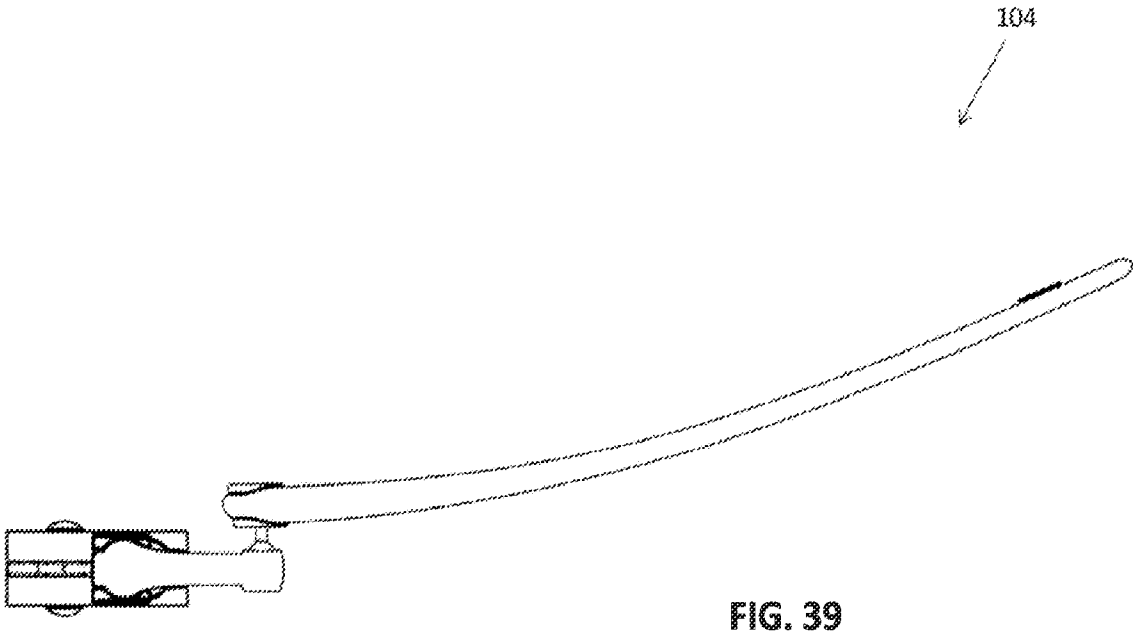
FIG. 39 is a top view of the visual and/or acoustic privacy feature shown in FIG. 35.

FIG. 34 illustrates the various components of the visual and/or acoustic privacy feature 104 according to an exemplary embodiment. As shown, the visual and/or acoustic privacy feature 104 includes a panel or screen element 116 supported by a frame 118. The frame 118 is coupled to a support arm 120 via a first rotatable joint or connection 124 (e.g., 360 degree ball joint, etc.). The first joint 124 preferably allows the frame 118 to be rotated or pivoted 360 degrees relative to the support arm 120.

The support arm 120 is coupled to a base 128 via a second rotatable joint or connection 132. The second joint 132 preferably allows the support arm 120 to be rotated or pivoted clockwise or counterclockwise 180 degrees relative to the base 128.

The base 128 may be mountable to the desk top 112 via a bracket 136 and clamping mechanism 140. The clamping mechanism 140 may be mechanically fastened (e.g., with screws, etc.) to the bracket 136. Then, the thumb screw portion of the clamping mechanism 140 may be rotated to thereby create a clamping force between the clamping mechanism 140 and bracket 136 for mounting to the desk top 112. Alternative embodiments may include different means for supporting or mounting the visual and/or acoustic privacy features 104, 108.

The visual and/or acoustic privacy feature 108 may include the same or similar components as the visual and/or acoustic privacy feature 104. Accordingly, the visual and/or acoustic privacy feature 108 may also include a panel or screen element 116, frame 118, support arm 120, first rotatable joint or connection 124, base 128, second rotatable joint or connection 132, bracket 136, and clamp 140.

A wide range of materials may be used for various components of the visual and/or acoustic privacy features 104, 108. By way of exemplary, the movable acoustic and/or visual privacy panels or screens 116 may comprise mesh fabric, metal, plastic, wood, frosted acrylic, marker board, monitor screen, sound soaking material, etc. The frame 118, support arm 120, base 128, joints 124 and 132 may be made of acrylonitrile butadiene styrene (ABS), polypropylene, plastic, molded polypropylene, metal, aluminum, stainless steel, etc.

The panels 116 may also be made out of a material that provides sound soaking ability but not necessarily as the speakers 117 (e.g., wireless speakers, hardwired speakers, other sound producing means, etc.) provide the ability to add sound masking at the individual. The panels 116 are configured to provide visual privacy and thereby limit visual distraction. In this illustrated embodiment, the panels 116 comprise mesh, which allows the user to at least partially see through the panels 116.

Figure 33:
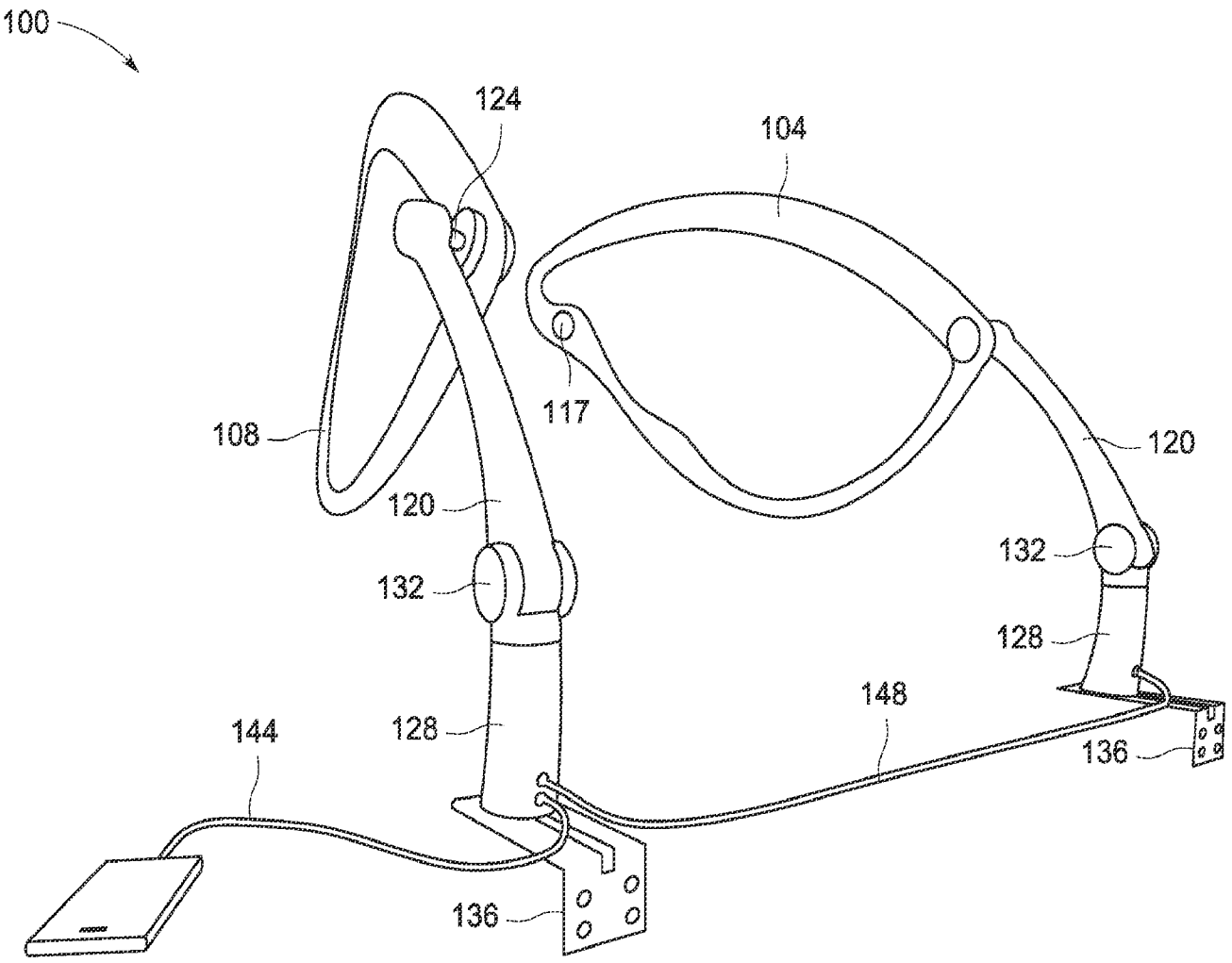
FIG. 33 is a front perspective view of the visual and/or acoustic privacy features in which the visual and/or acoustic privacy features would be adjacent the user's ears and along opposite sides of the user's head so as provide the user with at least some visual and/or acoustic privacy and isolation from others according to an exemplary embodiment.

FIG. 33 shows wires 144, 148 passing through hole in the base 128. In this exemplary, the wire 144 is connected to an external device, e.g., a smartphone with music to be played by speakers 117. The wire 148 connects the speakers 117 together. There may also be a charging means (e.g., an AC adapter port, a jack hole, etc.) on either or both of the visual and/or acoustic privacy features 104, 108 for charging an electronic device (e.g., a Bluetooth device, etc.) when applicable. In this exemplary, the speakers 117 are shown hardwired to each other and to an smartphone. In other exemplary embodiments, the speakers may be wirelessly connected to each other and/or to the smartphone, e.g., via Bluetooth, etc.

Additionally or alternatively, either or both visual and/or acoustic privacy features 104, 108 may be configured to be operable as a docking station for computer equipment, such that smartphones, tablets, etc. may be plugged in for power and/or stereo speakers may be run wirelessly or wires may be run under the desktop, table, countertop, or other surface supporting the visual and/or acoustic privacy features 104, 108.

Accordingly, the visual and/or acoustic privacy features 104, 108 may thus be usable akin to headphones but which are not placed directly on the user's head. This advantageously allows the user to be aware of the surroundings, while also allowing visual and/or acoustic privacy. For exemplary, the movable panel or screen elements 116 reduces visual distractions to the user, allows the user to focus better (e.g., on a computer monitor, etc.), and/or provide sound masking and/or music (e.g., via built in speakers 117, etc.) when positioned accordingly. The mount or support assemblies user also has the ability to selectively adjust the positioning of the movable panel or screen elements 116 into any number of different positions (e.g., to perhaps avoid a claustrophobic feeling of being closed in, etc.) while still having freedom of motion. The movable screens or panels 116 have an acoustic nature and can act as speakers/headphones without being applied to the head, such that the user is able to have privacy.

Although the above exemplarys show structures where a cover is coupled to a table or to the top of the chair, similar coupling mechanisms between the cover and the chair can be used with respect to coupling the wings discussed in FIG. 1A-1C to the chair.

In some exemplary embodiments, movable pads may be mounted to a support surface via flexible conduits or members that allow the movable pads to be movable or positionable generally about the user's head so as to act as a visual screen, where the pads may also have white noise and/or speaker capability. The pads may have a microphone and a speaker such that the pads are usable as or with a phone device, which pads also offer visual privacy. The moveable pads may provide sound masking and/or personal music selection. Unlike a loud speaker sitting on a desk that disrupts others nearby, the inventor's visual and/or acoustic privacy features may allow a user to listen to music without disrupting others nearby. The inventor's visual and/or acoustic privacy features may thus provide visual and acoustic privacy as well as telephone operation in some exemplary embodiments. In some exemplary embodiments, the inventor's visual and/or acoustic privacy features may comprise one or more pads that are operable as visual blinders as well as a speaker "floating" or suspended from a flexible conduit. The movable pads may allow the user to have and create a personal, more private environment in the open office setting.

Exemplary embodiments are also disclosed herein of chairs having visual and/or acoustic privacy features configured to acoustically dampen, muffle, or deaden both incoming sound (e.g., surrounding sound from coworkers conversations, paper shuffling, typing, etc.) and outgoing sound (e.g., the chair user's voice when speaking on the telephone, etc.). The visual and/or acoustic privacy features may comprise a visual screen having white noise and speaker capability.

In some exemplary embodiments, the chair is reconfigurable between at least a first configuration and a second configuration. In the first configuration, the chair's visual and/or acoustic privacy features are not visible (e.g., removed, retracted, stowed, etc.) such that the chair may appear as a typical or conventional chair (e.g., wingback chair, traditional office or task chair, etc.) without any visible visual and/or acoustic privacy features acoustic. But in the second configuration, the chair's visual and/or acoustic privacy features are visible and usable (e.g., attached, extended, deployed, etc.) for acoustically dampening incoming and outgoing sound.

By way of exemplary, the visual and/or acoustic privacy features may comprise wings, flaps, covers, panels, and/or portions at the ear level and mouth level. The visual and/or acoustic privacy features may be fully and/or partially retractable, pivotable, slidable, hinged, foldable, pliable, nesting, adjustable, removable from and re-attachable to a chair or other furniture piece, fixedly attached to the chair or other furniture piece, etc. Accordingly, additional aspects of the present disclosure relate to fold away, retractable, removable, or slidable visual and/or acoustic privacy features that provide audible privacy (e.g., acoustic dampening, etc.) and visual privacy to a user. For exemplary, an exemplary embodiment includes fully retractable visual and/or acoustic privacy features coupled to a chair headrest such that the visual and/or acoustic privacy features can be slid, pivoted, or folded away behind, inside, concealed by, or "blend" in with the chair headrest when not in use.

Some exemplary embodiments may also include a mouth piece or acoustic dampening portion at the mouth level as an option to offer more sound deadening characteristics. Alternative exemplary embodiments, however, may not include this mouth piece option and/or may include one or more visual and/or acoustic privacy features fixedly attached and not readily removable from the chair or other furniture piece.

A wide range of materials may be used for the visual and/or acoustic privacy features in exemplary embodiments, such as fabric, foam, plastic, leather, plexiglass, vinyl, metal, etc., which materials may be clear or transparent, frosted or translucent, or opaque, etc. For exemplary, the interior of the visual and/or acoustic privacy features may include a suitable sound dampening or redirecting material (e.g., a sound soaking foam, fabric, perforated metal, acrylic, other suitable materials, etc.). An exterior of the visual and/or acoustic privacy features may comprise the same material (e.g., leather, vinyl, etc.) that is used to make the chair headrest, seat, backrest, arms, etc. so that the visual and/or acoustic privacy features may blend in as just another option on a seating line.

In some embodiments, the visual and/or acoustic privacy features may be made of a clear or transparent acrylic or plexiglass material such that the user remains visible even when after the visual and/or acoustic privacy features are closed and in the second configuration. This may allow a boss or supervisor to see through the visual and/or acoustic privacy features when closed, for exemplary, to visually confirm that the user is working on company business and not surfing the internet, etc. Additionally, or alternatively, the visual and/or acoustic privacy features may be made of a soft or cushioned material for user comfort when the user's head is laying there against it, e.g., taking a nap, etc.

While aspects of this invention have been described in conjunction with the exemplary features outlined above, various alternatives, modifications, variations, improvements, and/or substantial equivalents, whether known or that are or may be presently unforeseen, may become apparent to those having at least ordinary skill in the art. Accordingly, the exemplary aspects of the invention, as set forth above, are intended to be illustrative, not limiting. Various changes may be made without departing from the spirit and thereof. Therefore, aspects of the invention are intended to embrace all known or later-developed alternatives, modifications, variations, improvements, and/or substantial equivalents.

What is claimed is:

1. A retrofitting apparatus for use with a chair, the chair including a seat portion that extends substantially parallel to a surface on which the chair is supported, and a back portion that extends substantially perpendicular to the seat portion and away from the surface, the back portion being configured to support a portion of a back of a user seated in the chair, the chair also including at least one elongated connector that connects the seat portion and the back portion, the retrofitting apparatus comprising:

a removable coupling structure connectable to the at least one elongated connector of the chair, the removable coupling structure including at least one connecting member configured to extend around a perimeter of a portion of the at least one elongated connector of the chair in an arcuate direction, the removable coupling structure including two substantially symmetrical opposing clamps provided on opposite sides of a threaded member and configured to adjust a distance between the clamps, wherein the distance between the clamps may be adjusted to fit a shape of the back portion of the chair, wherein the removable coupling structure further comprises a center member, located between the two opposing clamps, and configured to rigidly secure the removable coupling structure to the back portion of the chair and the center member is remotely attached to the two opposing clamps; and a cover connected to the coupling structure, the cover configured to project from at least a 180 degree radius around at least a portion of the back portion of the chair so as to extend around sides of the back of the user seated in the chair and configured to project above and cover a top of the user seated in the chair, wherein the cover is moveable by the user between a stored position and an operative position, the operative position being such that the cover fully surrounds at least three sides of the back portion;

the at least one connecting member of the removable coupling structure includes a two-piece clamping structure that secures the retrofitting apparatus to the chair, the two-piece clamping structure is configured to define an opening therebetween into which the portion of the at least one elongated connector of the chair is disposed, the opening has a parallelepiped shape, and has a soft polymeric elastic material therein configured to (i) conform to the shape of the opening and (ii) rigidly attach the clamping structure to the seat portion.

2. The retrofitting apparatus of claim 1, wherein the two-piece clamping structure is attachable to the cover.

3. The retrofitting apparatus of claim 1, wherein the cover includes rods that form boundaries of the cover.

4. The retrofitting apparatus of claim 3, wherein the cover includes a planar material that extends between and is supported by the rods.

5. The retrofitting apparatus of claim 4, wherein the planar material is fabric.

6. The retrofitting apparatus of claim 4, wherein the planar material is stretchable.

7. The retrofitting apparatus of claim 6, wherein the planar material is spandex.

8. The retrofitting apparatus of claim 4, wherein the rods are connected to and supported by the removable coupling structure.

9. The retrofitting apparatus of claim 4, wherein at least one of the rods extends within at least one aperture defined in the removable coupling structure.

10. The retrofitting apparatus of claim 4, wherein at least one of the rods is arcuate and passes through an aperture defined in the removable coupling structure, and extends along a plane that is approximately parallel to a direction of extension of the seat portion.

11. The retrofitting apparatus of claim 10, wherein the at least another of the rods extends vertically from the at least one of the rods approximately parallel to the direction of extension of the back portion of the chair.

12. The retrofitting apparatus of claim 11, wherein the at least another of the rods extends within an aperture defined in removable coupling structure.

13. The retrofitting apparatus of claim 11, wherein the at least another of the rods is connectable to the at least one of the rods.

* * * * *